US011280341B2

(12) United States Patent
Bauduin et al.

(10) Patent No.: US 11,280,341 B2
(45) Date of Patent: Mar. 22, 2022

(54) HEAT EXCHANGER ASSEMBLY

(71) Applicant: OVH, Roubaix (FR)

(72) Inventors: Hadrien Bauduin, Villeneuve d'Ascq (FR); Ali Chehade, Templeuve (FR)

(73) Assignee: OVH, Roubaix (FR)

( * ) Notice: Subject to any disclaimer, the term of this patent is extended or adjusted under 35 U.S.C. 154(b) by 63 days.

(21) Appl. No.: 16/988,216

(22) Filed: Aug. 7, 2020

(65) Prior Publication Data

US 2021/0062817 A1 Mar. 4, 2021

(30) Foreign Application Priority Data

Aug. 30, 2019 (EP) ..... 19315107

(51) Int. Cl.
*F28F 9/00* (2006.01)
*F04D 25/16* (2006.01)
(Continued)

(52) U.S. Cl.
CPC ..... *F04D 25/166* (2013.01); *F04D 25/0606* (2013.01); *F04D 29/325* (2013.01);
(Continued)

(58) Field of Classification Search
CPC .. F04D 25/166; F04D 25/0606; F04D 29/325; F04D 29/522; F04D 29/646;
(Continued)

(56) References Cited

U.S. PATENT DOCUMENTS 2,330,653 A 9/1943 Wilson
4,688,472 A 8/1987 Inglis
(Continued)

FOREIGN PATENT DOCUMENTS

CN 104654825 A 5/2015
CN 109059244 A 12/2018
(Continued)

OTHER PUBLICATIONS

European Communication pursuant to Article 94(3) EPC with regard to the European Patent Application No. 19315107.3 dated Sep. 25, 2020.
(Continued)

*Primary Examiner* — Davis D Hwu
(74) *Attorney, Agent, or Firm* — BCF LLP

(57) ABSTRACT

A heat exchanger assembly includes a heat exchanger panel disposed at an inclined orientation. A fan assembly is disposed vertically above the heat exchanger panel and includes a fan impeller connected to a fan mount. The fan impeller is sized and positioned such that part of the fan impeller rotates vertically above the upper end of the heat exchanger panel. A casing has a plurality of inner walls for guiding air from the heat exchanger panel toward the fan assembly. The inner walls include a sloped wall. A distance between an upper end of the sloped wall and a fan rotation axis is greater than a distance between a lower end of the sloped wall and the fan rotation axis. The sloped wall is adjacent to the upper end of the heat exchanger panel such that the part of the fan impeller rotates vertically above the sloped wall.

15 Claims, 17 Drawing Sheets

(51) Int. Cl.

| | |
|---|---|
| ***F04D 25/06*** | (2006.01) |
| ***F04D 29/32*** | (2006.01) |
| ***F04D 29/52*** | (2006.01) |
| ***F04D 29/64*** | (2006.01) |
| ***F04D 29/66*** | (2006.01) |
| ***F28C 1/10*** | (2006.01) |
| ***F28F 1/32*** | (2006.01) |
| ***F28D 1/04*** | (2006.01) |
| ***F28D 1/02*** | (2006.01) |

(52) U.S. Cl.
CPC ..... *F04D 29/522* (2013.01); *F04D 29/646* (2013.01); *F04D 29/66* (2013.01); *F28C 1/10* (2013.01); *F28D 1/024* (2013.01); *F28D 1/0452* (2013.01); *F28F 1/32* (2013.01); *F28F 2250/08* (2013.01); *F28F 2265/28* (2013.01)

(58) Field of Classification Search
CPC ..... F04D 29/66; F04D 1/024; F04D 1/0452; F28C 1/10; F28F 1/32; F28F 2250/08; F28F 2265/28
USPC ..... 165/67
See application file for complete search history.

(56) References Cited

U.S. PATENT DOCUMENTS

| | | | | |
|---|---|---|---|---|
| 6,321,556 | B1 * | 11/2001 | Tesche | F24F 1/0083 62/285 |
| 7,391,611 | B2 | 6/2008 | Ko et al. | |
| 7,806,228 | B2 | 10/2010 | Dyck et al. | |
| 8,210,308 | B2 | 7/2012 | Penner et al. | |
| 8,770,340 | B2 | 7/2014 | Cursetjee | |
| 8,813,908 | B1 | 8/2014 | Liu et al. | |
| 9,335,098 | B2 | 5/2016 | Pawlick | |
| 10,113,816 | B2 | 10/2018 | Akiyoshi et al. | |
| 10,260,772 | B2 | 4/2019 | Mouratidis | |
| 2004/0093880 | A1 | 5/2004 | Zheng et al. | |
| 2006/0131101 | A1 | 6/2006 | Crocker | |
| 2007/0051007 | A1 * | 3/2007 | Reets | F26B 3/02 34/86 |
| 2010/0329850 | A1 | 12/2010 | Feisthammel et al. | |
| 2016/0069618 | A1 * | 3/2016 | Elsner | F28D 9/04 165/121 |
| 2016/0131371 | A1 * | 5/2016 | Aoyama | F24F 1/56 165/122 |
| 2017/0276397 | A1 | 9/2017 | Mouratidis | |
| 2018/0106266 | A1 | 4/2018 | Bertels | |

FOREIGN PATENT DOCUMENTS

| | | | |
|---|---|---|---|
| DE | 1126430 | B | 3/1962 |
| WO | 2017/171571 | A1 | 10/2017 |

OTHER PUBLICATIONS

European Search Report with regard to the counterpart European Patent Application No. 19315107.3 completed Feb. 7, 2020.
English Abstract for CN109059244 retrieved on Espacenet on Aug. 6, 2020.
English Abstract for CN104654825 retrieved on Espacenet on Aug. 6, 2020.
English Translation for DE1126430 retrieved on Espacenet on Aug. 6, 2020.

* cited by examiner

HEAT EXCHANGER ASSEMBLY

CROSS-REFERENCE

The present application claims priority from European Patent Application No. 19315107.3, filed on Aug. 30, 2019, the entirety of which is incorporated herein by reference.

FIELD OF TECHNOLOGY

The present disclosure relates to heat exchanger assemblies such as dry coolers.

BACKGROUND

Heat exchanger assemblies are used to evacuate heat from environments that require a generally cool operating temperature. For instance, data centers typically rely on heat exchanger assemblies such as dry coolers to provide adequate cooling to the electronic devices (e.g., servers and others) operating therein. However, since dry coolers are installed outside of the data centers (e.g., on their roofs) to evacuate heated air into the surroundings, operation of dry coolers in populated areas can be problematic due to their high levels of sound emission which can be bothersome to inhabitants in the vicinity thereof.

Typically, sound emission from a dry cooler mainly results from the suction of air at the level of the dry cooler's heat exchanger panels and at the fans where heated air is discharged from the dry cooler.

Furthermore, while it is generally desirable to maximize the size of the fans of a dry cooler to increase its efficiency, this tends to even further exacerbate the already significant levels of sound emission of the dry cooler. In a similar manner, reducing the width of the dry cooler assembly to have a more compact and convenient dry cooler can have a detrimental effect on its sound emission as the fan becomes bigger in comparison.

Therefore, there is a need for a heat exchanger assembly which overcomes or reduces at least some of the above-described drawbacks.

SUMMARY

It is an object of the present technology to ameliorate at least some of the inconveniences present in the prior art.

According to an aspect of the present technology, there is provided a heat exchanger assembly. The heat exchanger assembly includes: a frame; a heat exchanger panel mounted to the frame and configured to exchange heat with air flowing therethrough, the heat exchanger panel having a lower end and an upper end, the heat exchanger panel being disposed at an inclined orientation such that the upper and lower ends thereof are offset from one another, the heat exchanger panel comprising: a tubing arrangement for circulating fluid therein; and a plurality of fins in thermal contact with the tubing arrangement, the fins being spaced apart from one another for air to flow therebetween and into an interior space of the heat exchanger assembly; a plurality of enclosing panels connected to the frame and defining in part the interior space of the heat exchanger assembly; a fan assembly disposed vertically above the heat exchanger panel, the fan assembly comprising: a fan mount; an a fan impeller connected to the fan mount, the fan impeller being rotatable about a fan rotation axis to pull air into the interior space of the heat exchanger assembly through the heat exchanger panel and evacuate heated air upwardly from the interior space of the heat exchanger assembly through the fan assembly, the fan impeller being sized and positioned such that part of the fan impeller rotates vertically above the upper end of the heat exchanger panel; a casing mounted to the frame between the fan assembly and the upper end of the heat exchanger panel, the casing comprising a plurality of inner walls for guiding air from the heat exchanger panel toward the fan assembly such that the inner walls of the casing define in part the interior space of the heat exchanger assembly, the plurality of inner walls of the casing including a sloped wall extending from a lower end to an upper end, a distance between the upper end of the sloped wall and the fan rotation axis being greater than a distance between the lower end of the sloped wall and the fan rotation axis, the sloped wall being adjacent to the upper end of the heat exchanger panel such that the part of the fan impeller rotates vertically above the sloped wall.

In some embodiments, the sloped wall extends generally parallel to the inclined orientation of the heat exchanger panel.

In some embodiments, an angle between the sloped wall of the casing and a vertical plane is between 20° and 40° inclusively.

In some embodiments, the fan rotation axis extends generally vertically.

In some embodiments, a ratio of a height of the casing over a diameter of the fan impeller is between 0.20 and 0.40.

In some embodiments, a ratio of a height of the casing over a vertical distance between the upper and lower ends of the heat exchanger panel is between 0.10 and 0.20.

In some embodiments, a ratio of a diameter of the fan impeller over a horizontal distance between the upper and lower ends of the heat exchanger panel is between 0.80 and 1.20.

In some embodiments, a height of the casing is between 200 and 400 mm inclusively.

In some embodiments, the height of the casing is between 250 and 350 mm inclusively.

In some embodiments, the height of the casing is approximately 320 mm.

In some embodiments, the plurality of inner walls of the casing also includes: two parallel walls; and a transversal wall extending between the two parallel walls and facing the sloped wall.

In some embodiments, the casing is made of sheet metal.

In some embodiments, the heat exchanger panel is a first heat exchanger panel; the fan assembly is a first fan assembly, and the fan rotation axis is a first fan rotation axis; the casing is a first casing; and the heat exchanger assembly further comprises: a second heat exchanger panel mounted to the frame and configured to exchange heat with air flowing therethrough, the second heat exchanger panel having a lower end and an upper end, the second heat exchanger panel being disposed at an inclined orientation such that the upper and lower ends thereof are offset from one another, the first and second heat exchanger panels being disposed in a V-configuration such that a distance between the upper ends of the first and second heat exchanger panels is greater than a distance between the lower ends of the first and second heat exchanger panels, the second heat exchanger panel comprising: a tubing arrangement for circulating fluid therein; and a plurality of fins in thermal contact with the tubing arrangement of the second heat exchanger panel, the fins of the second heat exchanger panel being spaced apart from one another for air to flow therebetween and into the interior space of the heat exchanger assembly; a second fan assembly disposed vertically above the second heat exchanger panel, the second fan assembly comprising: a fan mount; and a fan impeller connected to the fan mount of the second fan assembly, the fan impeller of the second fan assembly being rotatable about a second fan rotation axis to pull air into the interior space of the heat exchanger assembly through the second heat exchanger panel and evacuate heated air upwardly from the interior space of the heat exchanger assembly through the second fan assembly, the fan impeller of the second fan assembly being sized and positioned such that part thereof rotates vertically above the upper end of the second heat exchanger panel; a second casing mounted to the frame between the second fan assembly and the upper end of the second heat exchanger panel, the second casing comprising a plurality of inner walls for guiding air from the second heat exchanger panel toward the second fan assembly such that the inner walls of the second casing define in part the interior space of the heat exchanger assembly, the plurality of inner walls of the second casing including a sloped wall extending from a lower end to an upper end, a distance between the upper end of the sloped wall of the second casing and the second fan rotation axis being greater than a distance between the lower end of the sloped wall of the second casing and the second fan rotation axis, the sloped wall of the second casing being adjacent to the upper end of the second heat exchanger panel such that the part of the fan impeller of the second fan assembly rotates vertically above the sloped wall of the second casing.

In some embodiments, the sloped wall of the second casing extends generally parallel to the inclined orientation of the second heat exchanger panel.

In some embodiments, the frame comprises: a first leg and a second leg laterally spaced apart from the first leg; at least one lower transversal member extending laterally and interconnecting the first and second legs; a first upstanding member and a second upstanding member laterally spaced apart from the first upstanding member, the first and second upstanding members extending upwardly from the first and second legs; an upper transversal member extending laterally and connected to upper ends of the first and second upstanding members; and an upper frame assembly affixed to the upper transversal member and supporting the first and second casings, wherein: the first and second heat exchanger panels are disposed on opposite sides of a vertical plane extending through the first and second upstanding members; and the first fan rotation axis and the second fan rotation axis are disposed on opposite sides of the vertical plane extending through first and second upstanding members.

Embodiments of the present technology each have at least one of the above-mentioned object and/or aspects, but do not necessarily have all of them. It should be understood that some aspects of the present technology that have resulted from attempting to attain the above-mentioned object may not satisfy this object and/or may satisfy other objects not specifically recited herein.

Additional and/or alternative features, aspects and advantages of embodiments of the present technology will become apparent from the following description, the accompanying drawings and the appended claims.

BRIEF DESCRIPTION OF DRAWINGS

Further aspects and advantages of the present technology will become better understood with reference to the description in association with the following in which.

DETAILED DESCRIPTION

Figure 1:
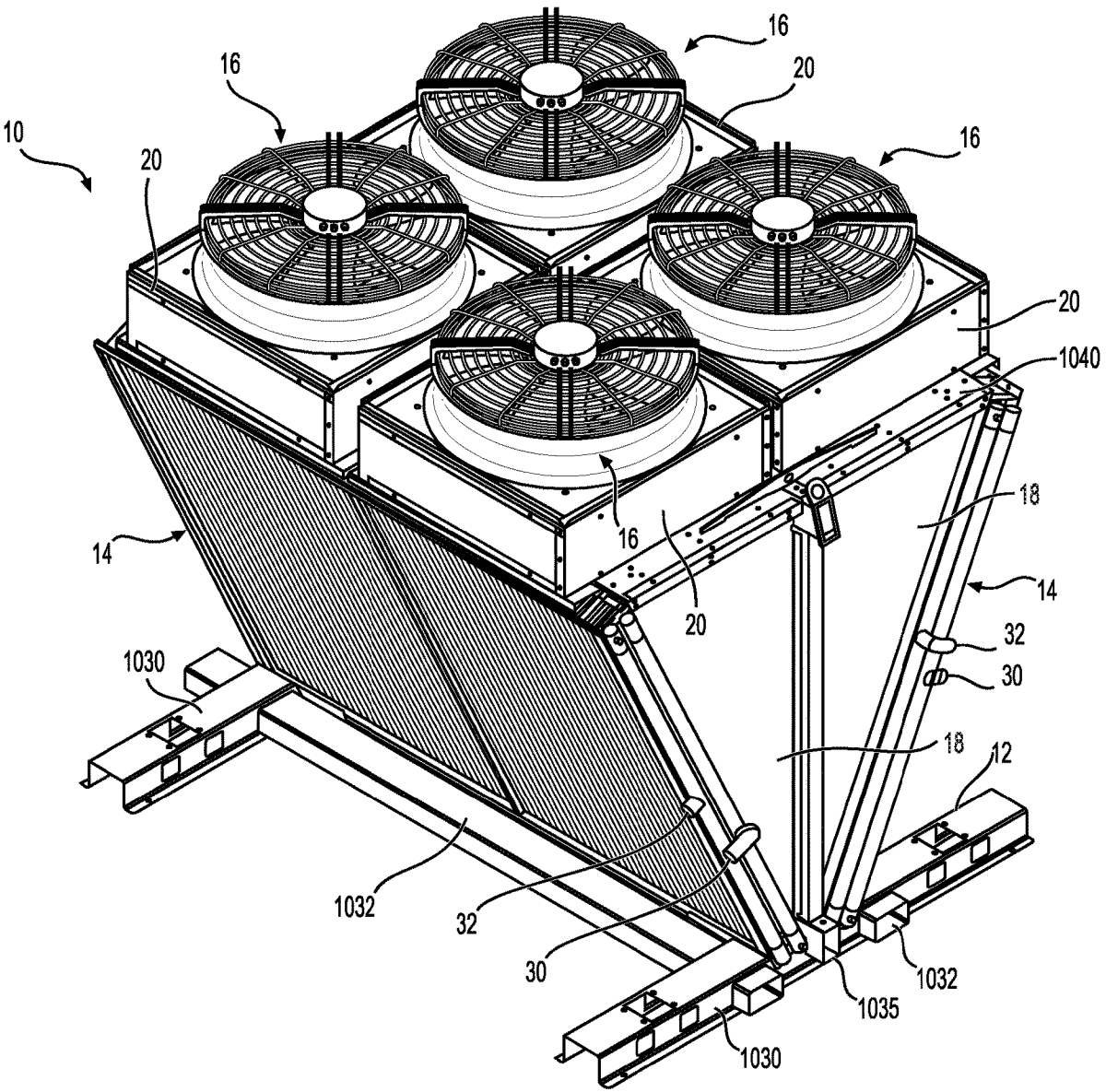
FIG. 1 is a perspective view of a heat exchanger assembly according to an embodiment of the present technology.

As seen in FIG. 1, there is provided a heat exchanger assembly 10 in accordance with an embodiment of the present technology. In this embodiment, the heat exchanger assembly 10 is a dry cooler 10. However, it is contemplated that any other suitable type of heat exchanger assembly (e.g., a condenser, a chiller) may be constructed in the manner that will be described below.

The dry cooler 10 comprises a frame 12 which supports the dry cooler 10 on a support surface (e.g., a roof of a building), a plurality of heat exchanger panels 14 for exchanging heat with air flowing therethrough, and a plurality of fan assemblies 16 for pulling air through the heat exchanger panels 14 and discharging air from an interior space 25 of the dry cooler 10. A plurality of enclosing panels 18, 19 (FIG. 6) are also affixed to the frame 12 to define in part the interior space 25 of the dry cooler 10.

As will be described in greater detail below, the dry cooler 10 is also provided with casings 20 (each one associated with a respective one of the fan assemblies 16) to attenuate sound emissions generated by the dry cooler 10.

Figure 18:
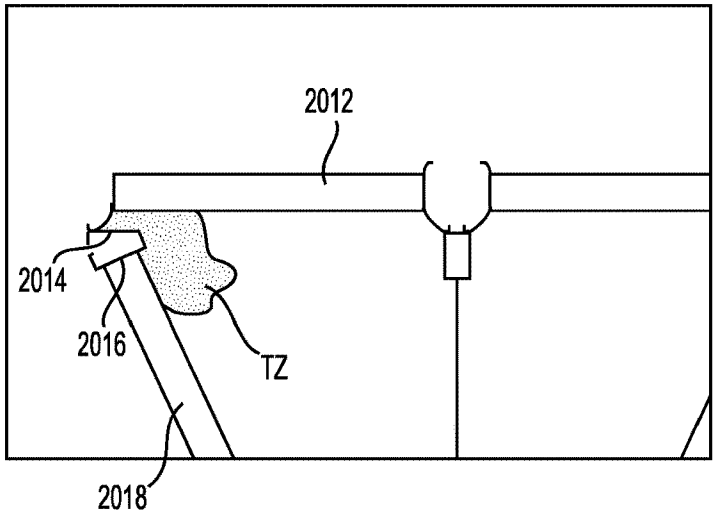
FIG. 18 (PRIOR ART)
FIG. 18 is a cross-sectional view of part of the conventional dry cooler of FIG. 17.
Figure 17:
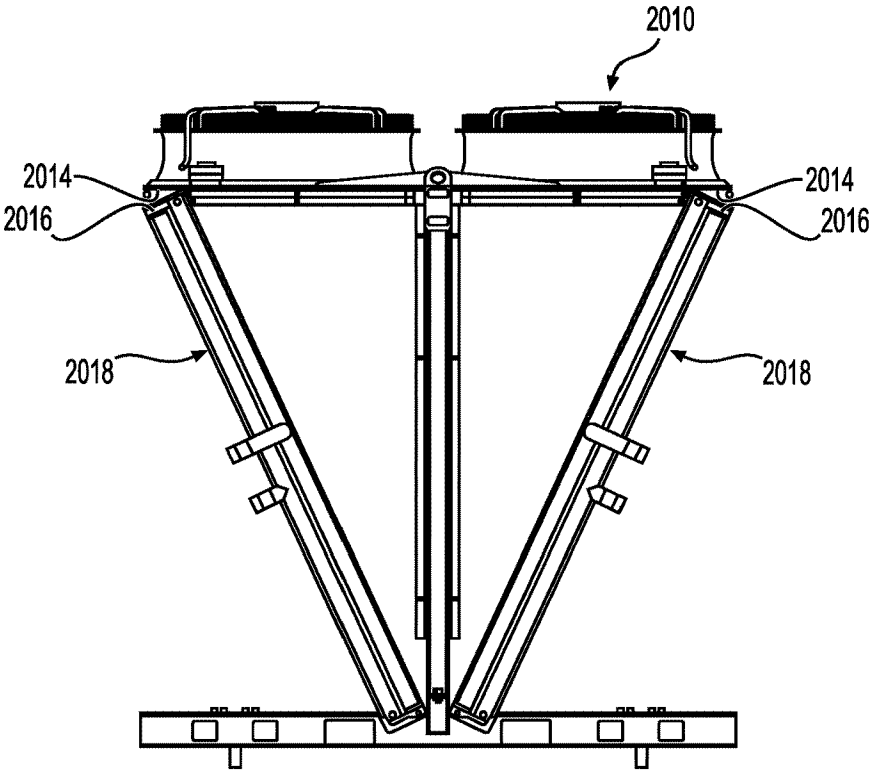
FIG. 17 (PRIOR ART)
FIG. 17 is a side elevation view of a conventional dry cooler according to the prior art.

Notably, with reference to FIGS. 17 and 18, a significant source of sound emission in a conventional dry cooler 2010 has been found to be caused by a "blade-passing effect" which involves part of a fan impeller 2012 of the dry cooler 2010 passing over a plate member 2014 disposed atop an upper end 2016 of a heat exchanger panel 2018. In particular, with reference to FIG. 18 which illustrates a cross-section of the conventional dry cooler 2010, a fluid flow analysis has shown that the proximity of the fan impeller 2012 to the plate member 2014 causes the flow of air within the dry cooler 2012 to be turbulent at zone TZ between the fan impeller 2012 and the plate member 2014. This turbulent flow has been identified as a significant source of noise produced by the conventional dry cooler 2010, in addition to generating significant vibrations which can negatively affect the life cycle of certain components of the dry cooler 2010. It should be pointed out that the blade-passing effect is in part a result of a desire to produce a narrower dry cooler 2010 (which makes it easier to transport and affords more space in the environment in which it is installed) while simultaneously having a fan impeller 2012 of a significant diameter to improve the efficiency of the dry cooler 2010. As will be described below, the casings 20 of the dry cooler 10 alleviate this blade-passing effect such that the dry cooler 10 is relatively quiet in comparison to the conventional dry cooler 2010.

Figure 5:
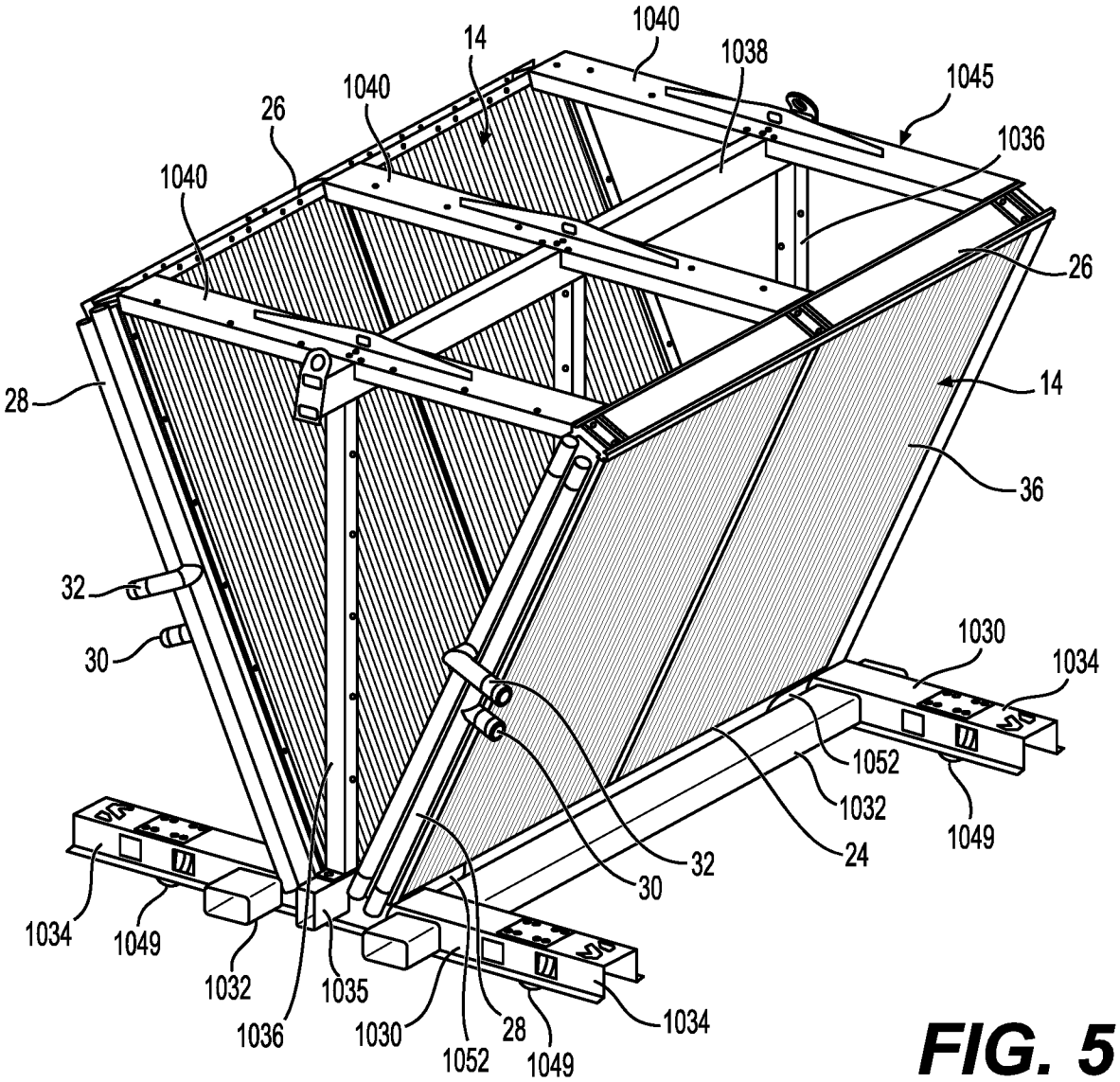
FIG. 5 is a perspective view of a frame and heat exchanger panels of the heat exchanger assembly of FIG. 1.
Figure 6:
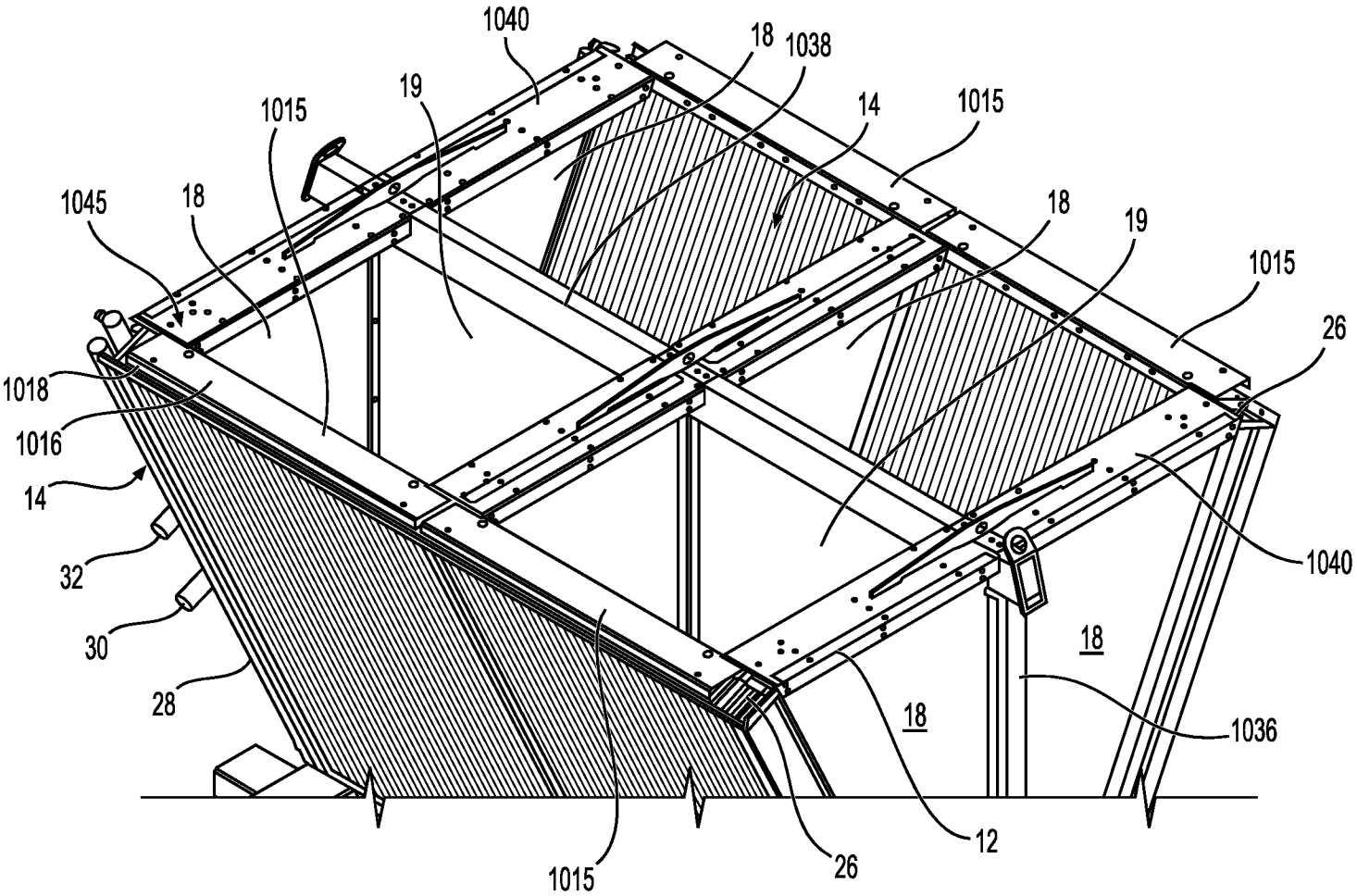
FIG. 6 is a perspective view of part of the frame and heat exchanger panels of the heat exchanger assembly of FIG. 1.
Figure 7:
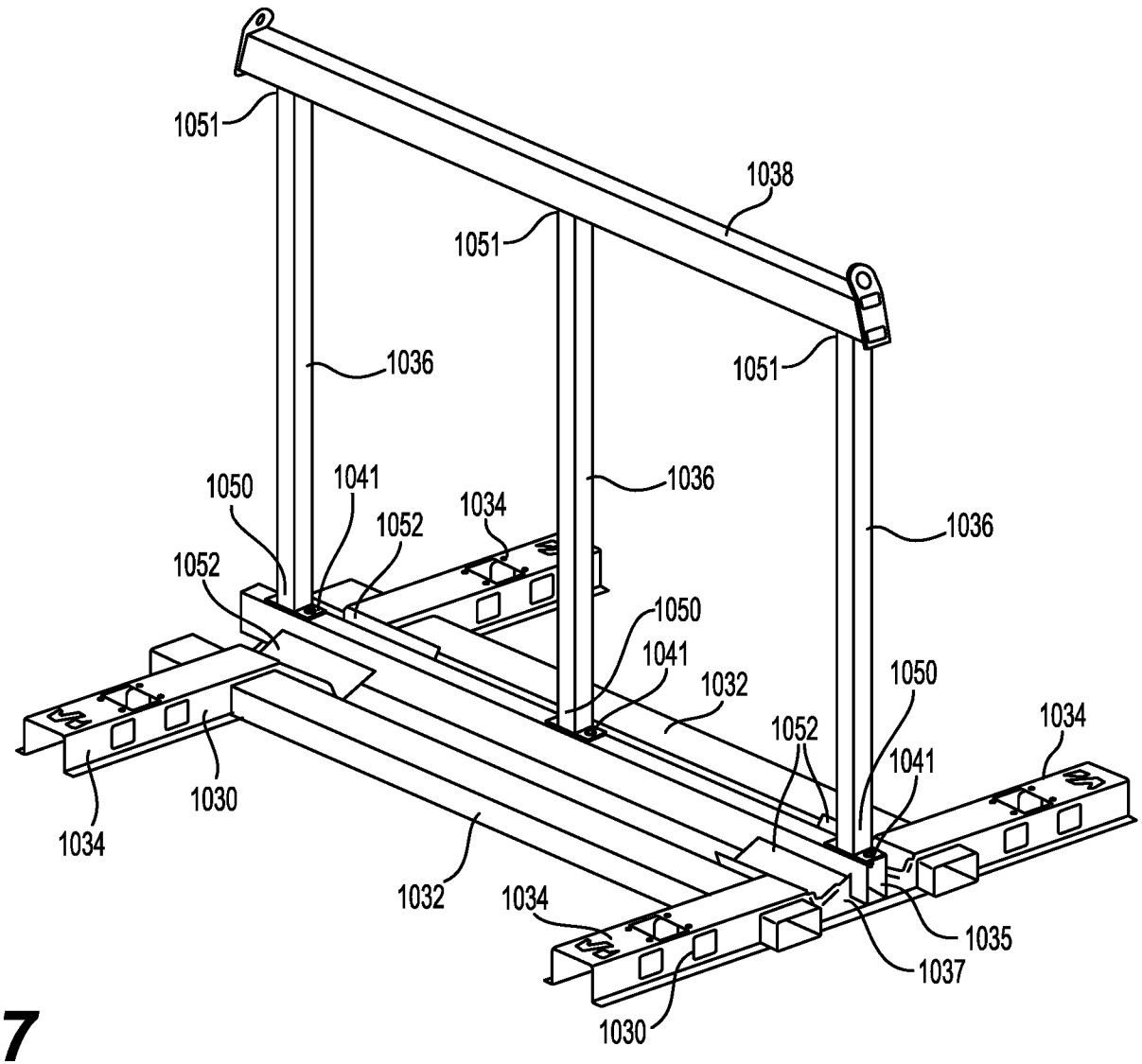
FIG. 7 is a perspective view of part of the frame of the heat exchanger assembly of assembly FIG. 1.
Figure 8:
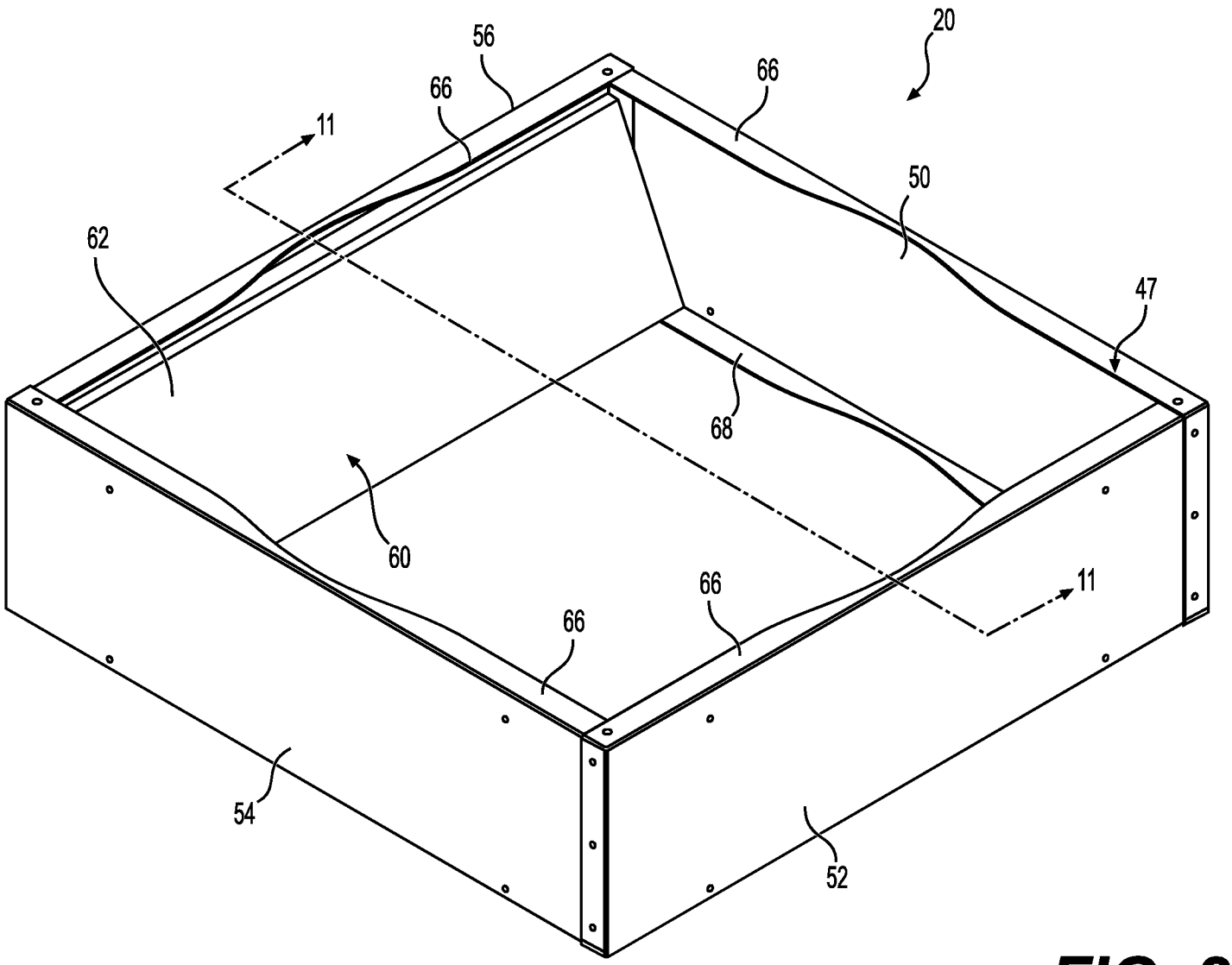
FIG. 8 is perspective view of a casing of the heat exchanger assembly of FIG. 1.
Figure 9:
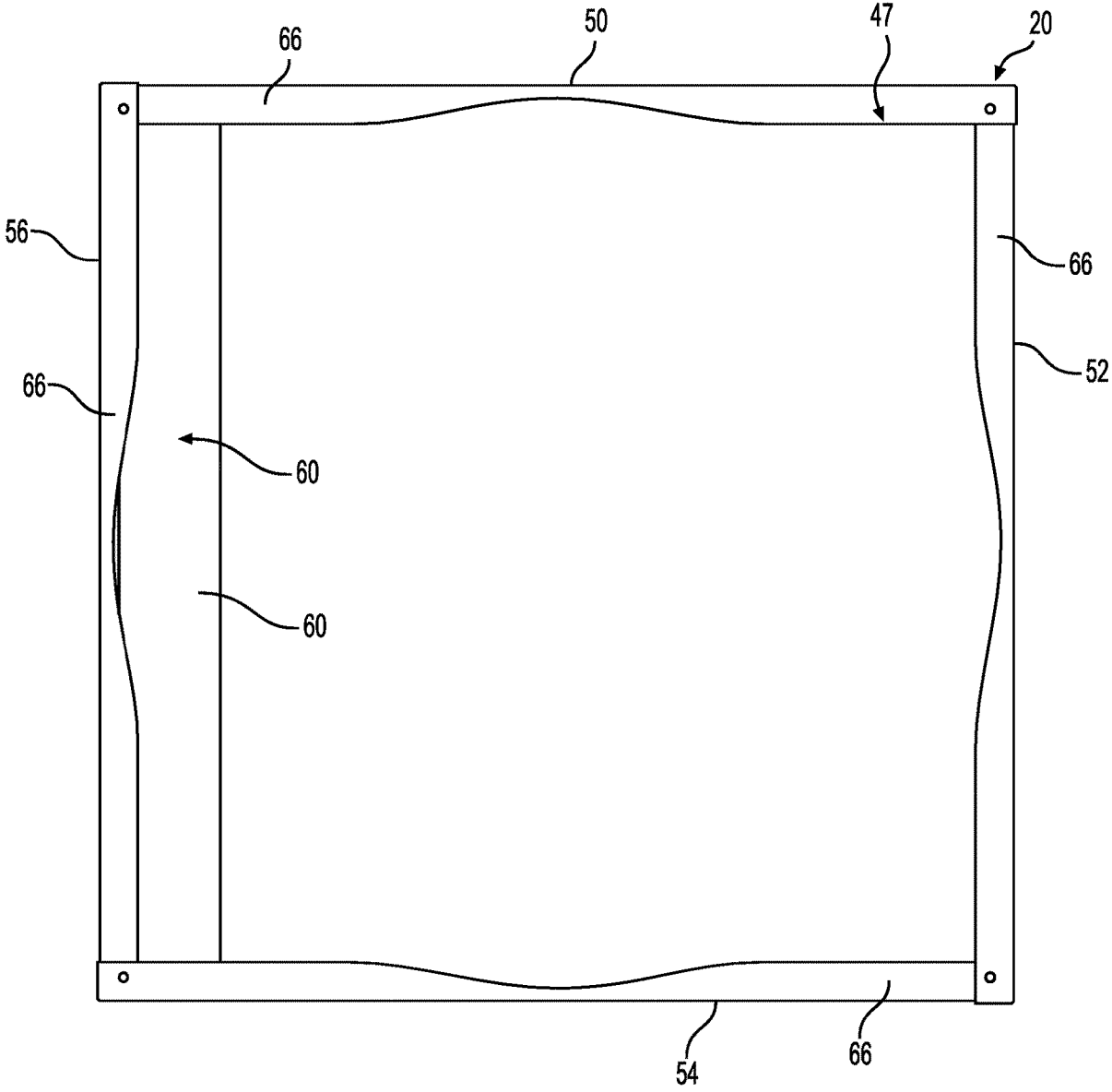
FIG. 9 is a top plan view of the casing of FIG. 8.
Figure 10:
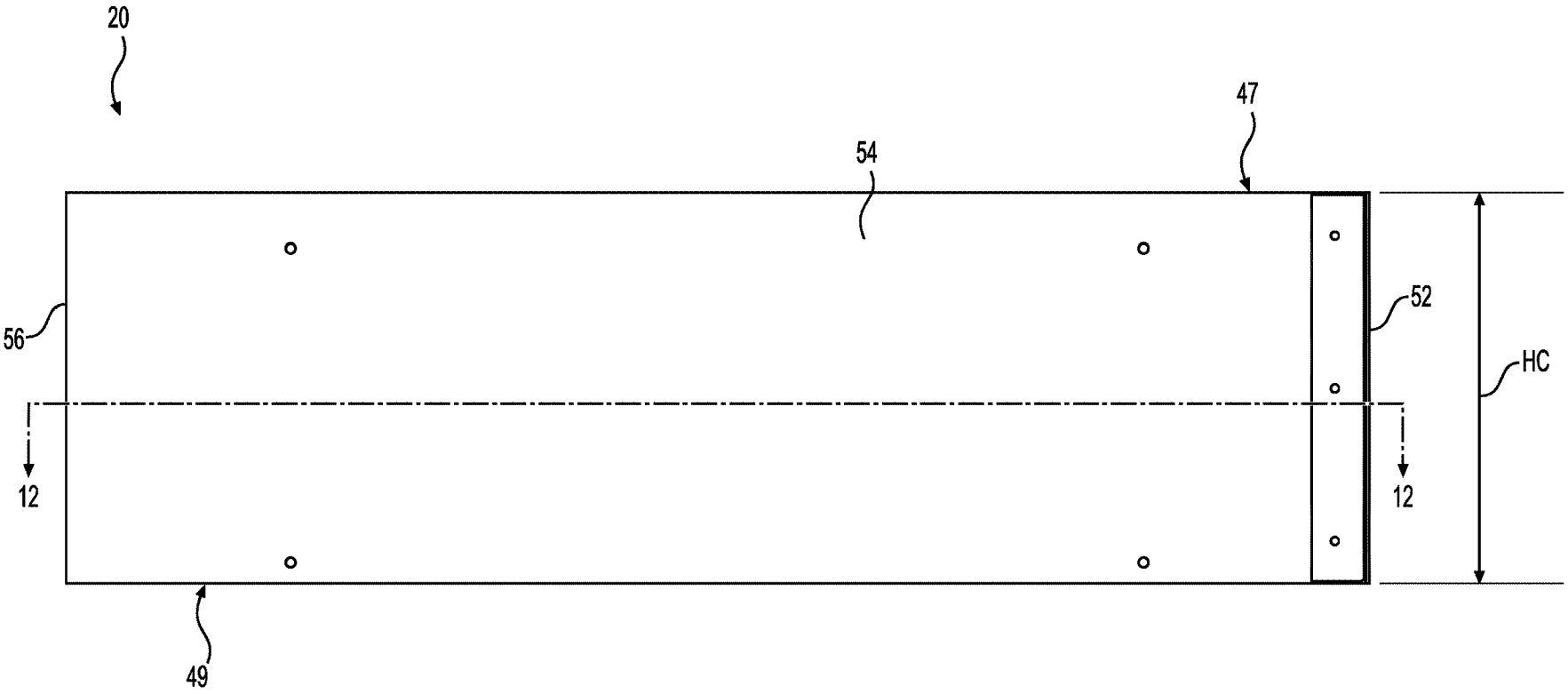
FIG. 10 is a side elevation view of the casing of FIG. 8.

Returning now to the dry cooler 10 of the present technology, with reference to FIGS. 5 to 7, the frame 12 is configured to support various components of the dry cooler 10. To that end, the frame 12 comprises two legs 1030 laterally spaced apart from one another and which support the dry cooler 10 on the support surface. Each of the legs 1030 extends from a first end to a second end and has opposite end portions 1034 and a central portion 1037 between the end portions 1034. In this embodiment, the end portions 1034 of each of the legs have a U-shaped cross-section while the central portion 1037 has a generally planar configuration forming a wall that extends along a plane extending vertically and parallel to the legs 1030. In some embodiments, the dry cooler 10 may include wheels 1049 (e.g., caster wheels) (FIG. 5) that are connected to the end portions 1034 of the legs 1030 such that the dry cooler 10 can be more easily displaced. For instance, this may facilitate moving the dry cooler 10 in/out of a container for transport.

Interconnecting the legs 1030 is a lower transversal member 1035 which extends laterally (i.e., transversally to the legs 1030) and interconnects the legs 1030 of the frame 12. In this embodiment, the lower transversal member 1035 is centered between the ends of each of the legs 1035 and is thus connected to the central portion 1037 of each of the legs 1030. More specifically, in this example, each of the legs 1030 has a cut-out configured to support therein part of the lower transversal member 1035. To that end, the cut-out has a shape and dimensions designed to receive the lower transversal member 1035.

A pair of bracing members 1032 also extend laterally (i.e., parallel to and spaced apart from the lower transversal member) to interconnect the legs 1030. More specifically, the end portions 1034 of each of the legs 1030 have a rectangular groove for receiving a respective one of the bracing members 1032. The bracing members 1032 may be connected to the legs 1030 in any suitable way. In this example, the bracing members 1032 are fastened (e.g., welded) to the legs. The bracing members 1032 are positioned such that the lower transversal member 1035 is disposed between the bracing members 1032. The bracing members 1032 may be used to lift the dry cooler 10 via a forklift or other work vehicle, with the forks thereof being engaged within the cavity of each of the bracing members.

A plurality of angular members 1052 are located between the legs 1030 and are configured to support the heat exchanger panels 14 of the dry cooler 10. In this embodiment, four angular members 1052 are provided, with each angular member 1052 being disposed between a respective one of the bracing members 1032 and the lower transversal member 1035 such that two of the angular members 1052 are located on one side of the lower transversal member 1035 while the other two angular members 1052 are located on the opposite side of the lower transversal member 1035. Moreover, in this embodiment, each of the angular members 1052 is connected to a respective one of the legs 1030 and to the lower transversal member 1035. It is contemplated that, in alternative embodiments, the angular members 1052 could be connected solely to the lower transversal member 1035. The angular members 1052 have an angular configuration for conforming to the orientation of lower ends 24 of the heat exchanger panels 14. Notably, each angular member 1052 includes two upwardly oriented faces that are transversal (e.g., perpendicular) to one another and converge at a junction. In this embodiment, the angular member is a bent component such that the junction is a bend in the angular member.

The frame 12 further comprises three upstanding members 1036 laterally spaced apart from one another and extending upwardly (e.g., vertically) from the lower transversal member 1035. Notably, each of the upstanding members 1036 extends from a lower end portion 1050 that is connected to the lower transversal member 1050 to an upper end portion 1051. The upstanding members 1036 can be connected to the lower transversal member 1035 in any suitable way. In this embodiment, as shown in FIG. 7, fasteners (e.g., bolts) fasten a flange 141 at the lower end portion 1050 of each of the upstanding members 1036 to the lower transversal member 1035. An upper transversal member 1038, extending laterally and connecting the upper end portions 1051 of the upstanding members 1036, is disposed above the lower transversal member 1035. The upper transversal member 1038 is connected to the upstanding members 1036 in any suitable way (e.g., welded).

An upper frame assembly 1045 is affixed to the upper transversal member 1038 and is configured to support the casings 20. The upper frame assembly 1045 comprises three upper retaining members 1040 which extend transversally to the upper transversal member 1038 and parallel to the legs 1030. The upper retaining members 1040 are laterally spaced apart from one another and are connected to the upper transversal member 1038. More specifically, an underside of each of the upper retaining members 1040 has a cut-out of an appropriate shape and size for receiving part of the upper transversal member 1038.

In this embodiment, the lower transversal member 1035, the upstanding members 1036, the upper transversal member 1038 and the upper retaining members 1040 are tubular, defining an interior space therein. This may allow the frame to support a greater load than if the members were made of sheet metal as is typically the case in conventional dry cooler assemblies.

As best seen in FIG. 5, the heat exchanger panels 14 are mounted to the frame 12 and configured to exchange heat with air flowing therethrough. In this embodiment, the dry cooler 10 includes two heat exchanger panels 14, each being disposed on opposite sides of a vertical plane extending through the upstanding members 1036 of the frame 12, such that the heat exchanger panels 14 are arranged on each side of the lower transversal member 1035 of the frame 12. The lower end 24 of each heat exchanger panel 14 is supported by a respective one of the angular members 1052 of the frame 12 while an upper end 26 of each heat exchanger panel 14 is affixed to the upper frame assembly 1045. In particular, the upper end 26 of each of the heat exchanger panels 14 is connected to the ends of upper retaining members 1040 via fasteners (e.g., bolts). Moreover, the lower end 24 of each of the heat exchanger panels 14 is supported by at least one of the angular members 1052 of the frame 12 such that the lower end 24 of each of the heat exchanger panels 14 is disposed between the bracing members 1032 of the frame 12. The lower end 24 of each of the heat exchanger panels 14 is fastened (e.g., bolted) to the angular members 1052.

Figure 4:
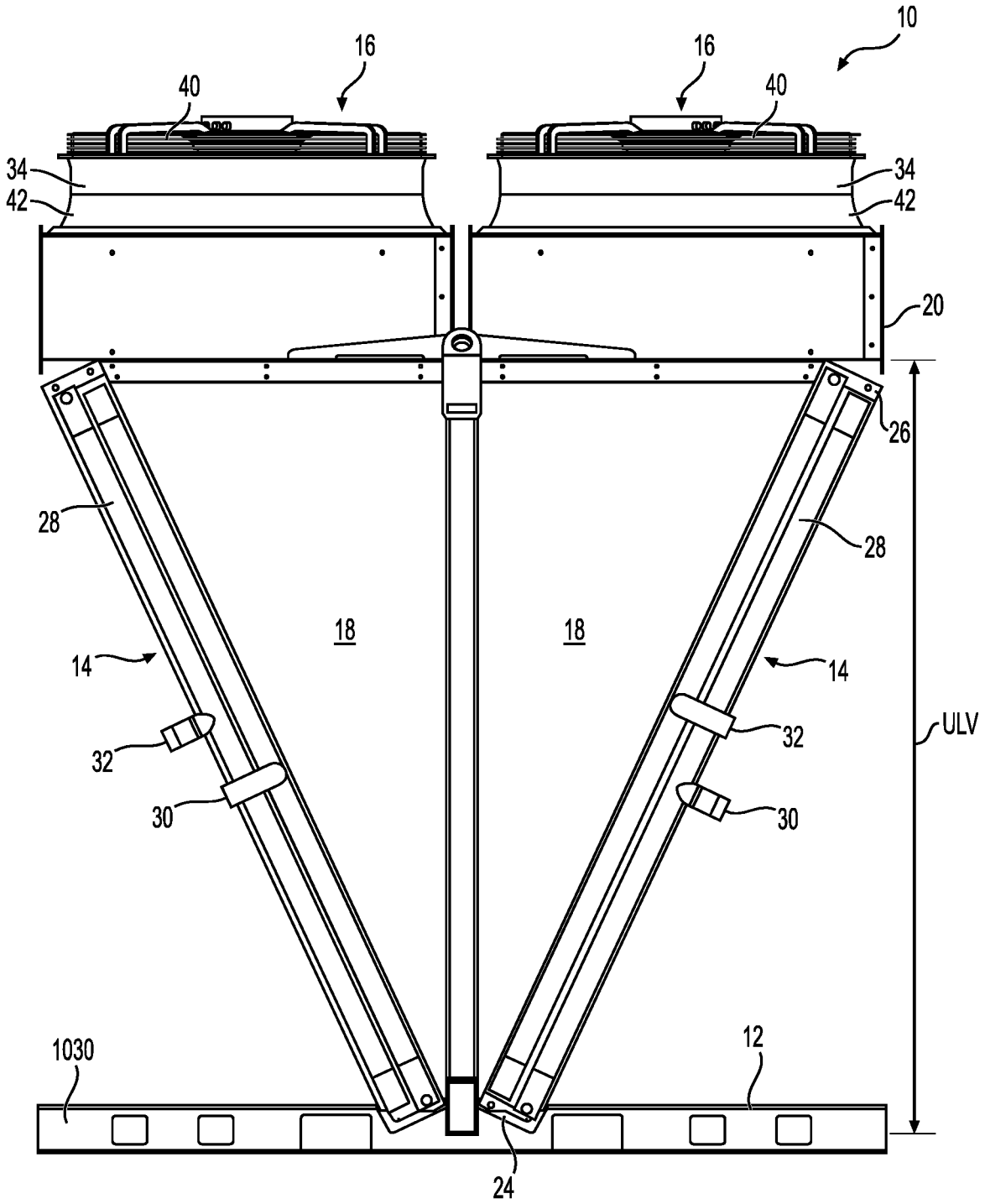
FIG. 4 is a side elevation view of the heat exchanger assembly of FIG. 1.

Notably, as best seen in FIG. 4, each of the heat exchanger panels 14 is disposed in an inclined orientation such that the upper and lower ends 24, 26 thereof are offset from one another. In particular, the two heat exchanger panels 14 are disposed in a V-configuration such that a distance between the upper ends 26 of the heat exchanger panels 14 is greater than a distance between the lower ends 24 of the heat exchanger panels 14. For instance, an angle formed between the heat exchanger panels 14 may be approximately 50°. This configuration reduces the footprint, or amount of ground space occupied by the dry cooler 10 and facilitates its transport, notably in shipping containers, or heavy-duty trailers, and the like.

Moreover, as shown in FIG. 6, four outer fan supporting members 1015 are connected to respective ones of the heat exchanger panels 14 and are configured to support respective ones of the fan assemblies 16. In particular, the outer fan supporting members 1015 are provided to support an outer part of a corresponding one of the fan assemblies 16 due to a significant diameter of a fan impeller thereof which extends beyond the innermost point of an upper end 26 of the corresponding heat exchanger panel 14. As such, each of the outer fan supporting members 1015 is disposed vertically above the upper end 26 of one of the heat exchanger panels 14. Notably, the upper end 26 of each heat exchanger panel 14 is disposed vertically below two of the outer fan supporting members 1015. Each outer fan supporting member 1015 is generally elongated and extends laterally (i.e., parallel to the upper transversal member 1038). Each outer fan supporting member 1015 has a flat plate portion 1016 and two lip portions 1018 (only one of which is shown in the Figures) extending downwardly and perpendicularly from the flat plate portion 1016. Both the flat plate portion 1016 and the lip portions 1018 extend along an entire length of the outer fan supporting member 1015. The flat plate portion 1016 is configured for affixing the corresponding fan assembly 16 thereto. Notably, the flat plate portion 1016 is provided with openings for receiving corresponding fasteners therein to affix the fan assembly 16 to the flat plate portion 1016. The innermost lip portion 1018 is affixed to the upper end 26 of the corresponding heat exchanger panel 14.

It is to be understood that the expression "vertically above" used herein to describe the positioning of components refers to a component being vertically higher than another component while simultaneously being at least partly laterally and longitudinally aligned with that component. Similarly, the expression "vertically below" used herein refers to a component being vertically lower than another component while simultaneously being at least partly laterally and longitudinally aligned with that component.

It is contemplated that, in other embodiments, two outer fan supporting members 1015 may be provided instead of four, with each outer fan supporting member 1015 extending above the upper end 26 of one of the heat exchanger panels 14.

As both heat exchanger panels 14 are configured identically in this embodiment, only one of the heat exchanger panels 14 will be described in detail below. It is understood that the same description applies to the other heat exchanger panel 14.

Figure 2:
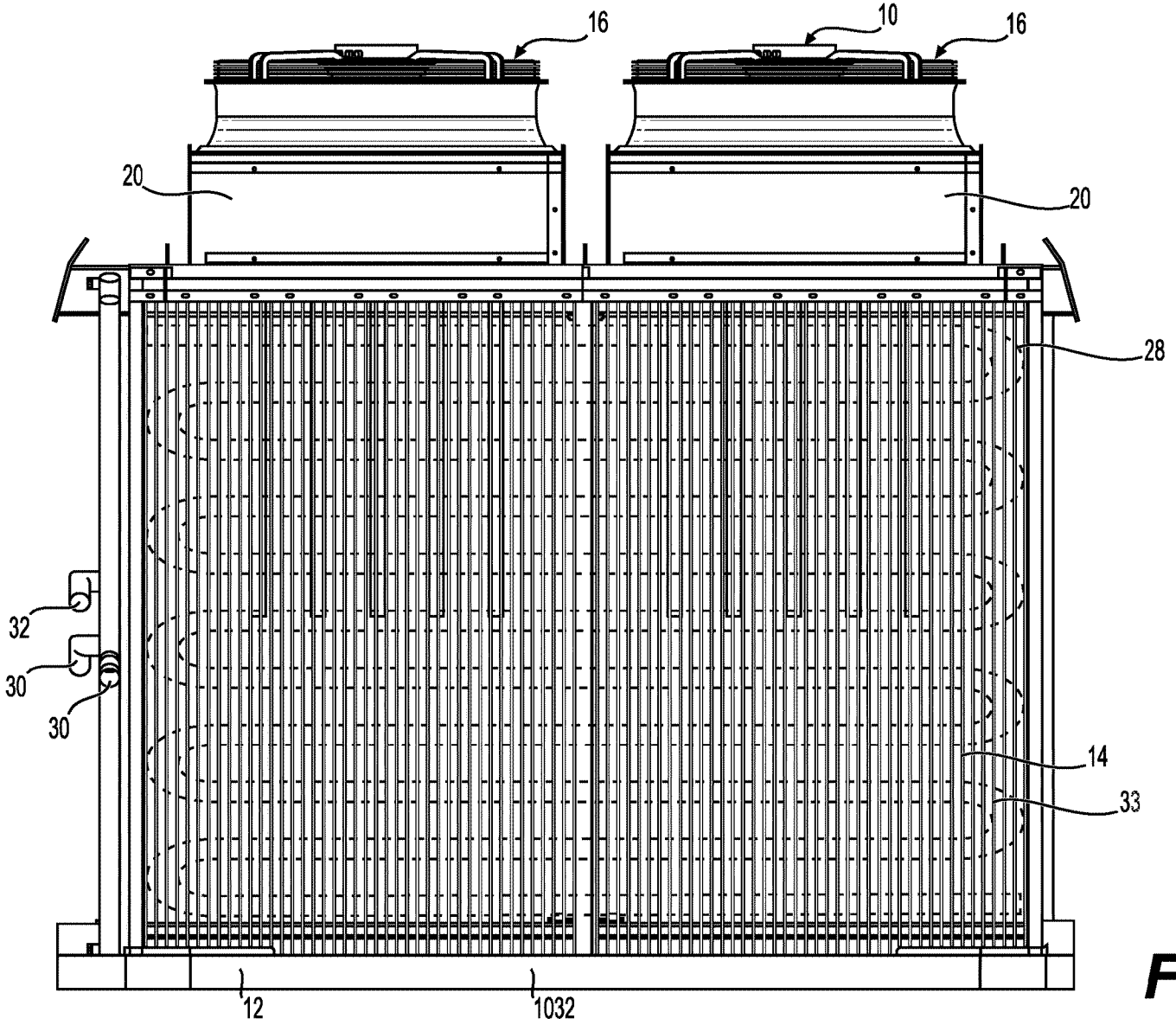
FIG. 2 is a front elevation view of the heat exchanger assembly of FIG. 1.
Figure 3:
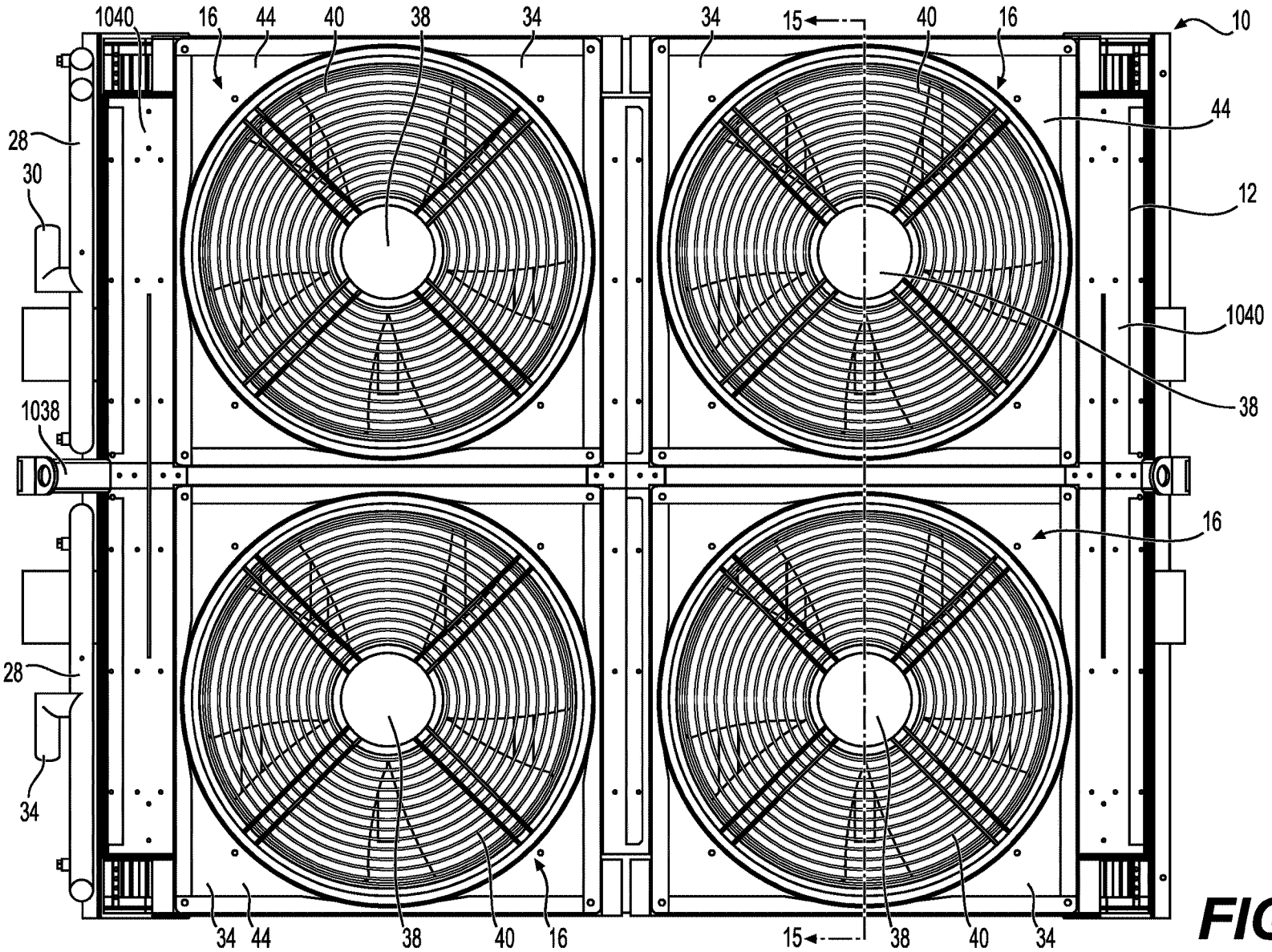
FIG. 3 is a top plan view of the heat exchanger assembly of FIG. 1.

The heat exchanger panel 14 comprises a tubing arrangement 28 for circulating fluid therein, best seen in FIG. 2. In this embodiment, the fluid circulated in the tubing arrangement 28 is water; however, it is contemplated that other fluids or additional fluids (e.g., glycol) could circulate within the tubing arrangement 28 as well. The fluid enters the tubing arrangement 28 through a fluid intake 30, and exits the tubing arrangement through a fluid outtake 32. As air is pulled into the dry cooler 10 through the heat exchanger panel 14, heat is transferred from water circulating in the tubing arrangement 28 to the air being pulled into the dry cooler 10. As such, the water circulating in the tubing arrangement 28 is cooled while, conversely, the air pulled into the dry cooler 10 is heated.

As best seen in FIG. 2, the heat exchanger panel 14 also comprises a plurality of fins 33 in thermal contact with the tubing arrangement 28 to facilitate heat exchange between fluid circulating in the tubing arrangement 28 and air pulled into the dry cooler 10. The fins 33 are spaced apart from one another for air to flow therebetween and into the interior space 25 of the dry cooler 10.

In alternative embodiments, each heat exchanger panel 14 may be replaced by a plurality of heat exchanger panels (e.g., two heat exchanger panels) arranged to be laterally-adjacent to one another (i.e., disposed side-by-side) to form a series of laterally-adjacent heat exchanger panels. In such embodiments, each series of laterally-adjacent heat exchanger panels would thus be disposed on opposite sides of the vertical plane extending through the upstanding members 1036 of the frame 12.

As shown in FIGS. 1, 4 and 6, the enclosing panels 18, 19 are connected to the frame 12 and define in part the interior space 25 of the dry cooler 10. More specifically, the enclosing panels 18, 19 define in part the lateral outer boundaries of the interior space 25 of the dry cooler 10 and also sub-divide the interior space 25 into sub-compartments, each sub-compartment being associated with a respective one of the fan assemblies 16. The enclosing panels 18, 19 include side enclosing panels 18 and middle enclosing panels 19 which extend perpendicularly to one another. Notably, the side enclosing panels 18 generally extend along a longitudinal plane (extending parallel to the legs 1030 of the frame 12) while the middle enclosing panels 19 generally extend along a lateral plane perpendicular to the longitudinal plane. In this embodiment, the dry cooler 10 includes six side enclosing panels 18 and two middle enclosing panels 19.

Each of the side enclosing panels 18 is connected to a respective one of the upstanding members 1036 of the frame 12, to an adjacent portion of an upper retaining member 1040, and to a respective one of the heat exchanger panels 14. As such, each upstanding member 1036 of the frame 12 is connected to two of the side enclosing panels 18. The side enclosing panels 18 which are disposed at the lateral extremities of the dry cooler 10 define outer walls of the dry cooler 10. On the other hand, the side enclosing panels 18 which are disposed between the lateral extremities of the dry cooler 10, namely between laterally-adjacent ones of the fan assemblies 16, define inner walls of the dry cooler 10 that sub-divide the interior space of the dry cooler 10 into laterally-adjacent sub-compartments. Given the inclined orientation of the heat exchanger panels 14, in this embodiment, the side enclosing panels 18 are generally triangular in shape.

Each of the middle enclosing panels 19 is connected to adjacent ones of the upstanding members 1036 of the frame 12, to an adjacent portion of the upper transversal member 1038 and to the lower transversal member 1035. The middle enclosing panels 19 thus define inner walls of the dry cooler 10 that sub-divide the interior space 25 of the dry cooler 10 into longitudinally-adjacent sub-compartments. Therefore, together, the middle enclosing panels 19 and the side enclosing panels 18 which are disposed between the lateral extremities of the dry cooler 10 define the inner walls of the dry cooler 10 which sub-divide the interior space 25 of the dry cooler 10, and together with the other side enclosing panels 18 allow for each fan assembly 16 to have an isolated volume within which to pull air into and evacuate air therefrom. In this embodiment, the middle enclosing panels 19 are generally rectangular.

With reference to FIGS. 1 to 4, the fan assemblies 16 are disposed above and mounted to the casings 20 such that the casings 20 are disposed between the fan assemblies 16 and the upper ends 26 of the heat exchanger panels 14. As each fan assembly 16 is configured identically in this embodiment, only one of the fan assemblies 16 will be described in detail herein. It is understood that the same description applies to the other fan assemblies 16.

Figure 12:
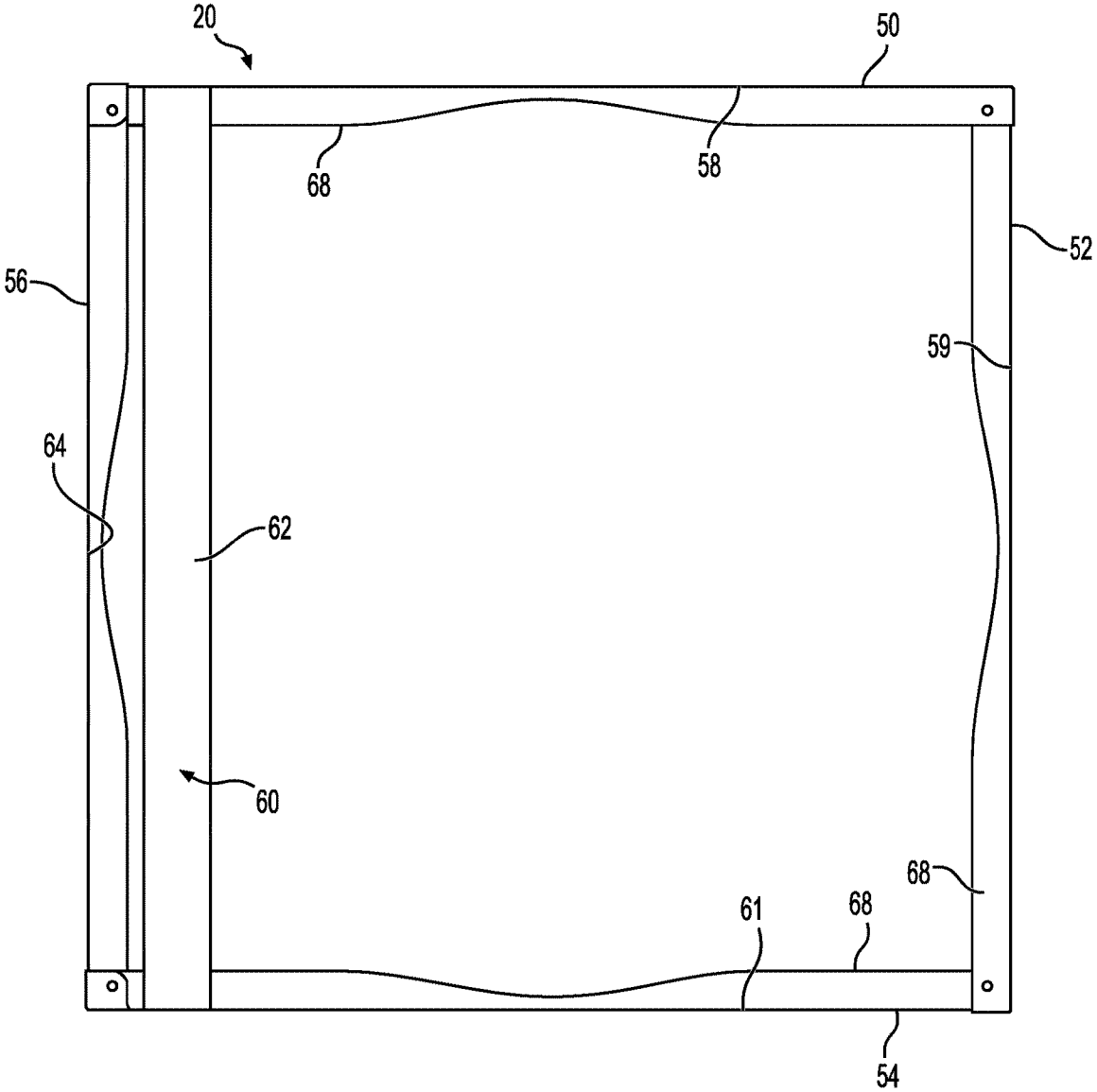
FIG. 12 is a cross-sectional view of the casing of FIG. 8 taken along line 12-12 in FIG. 10.
Figure 13:
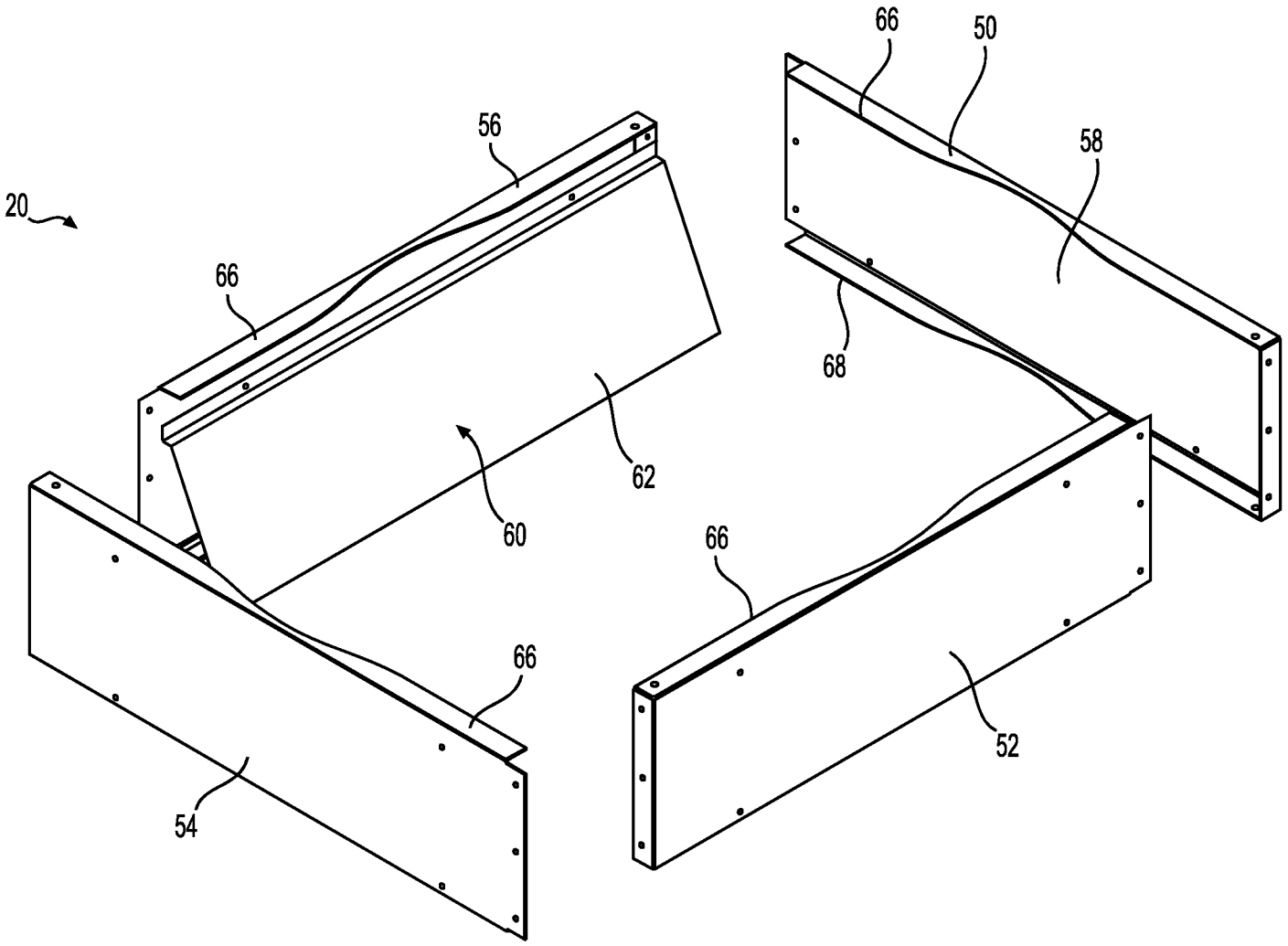
FIG. 13 is an exploded view of the casing of FIG. 8.
Figure 15:
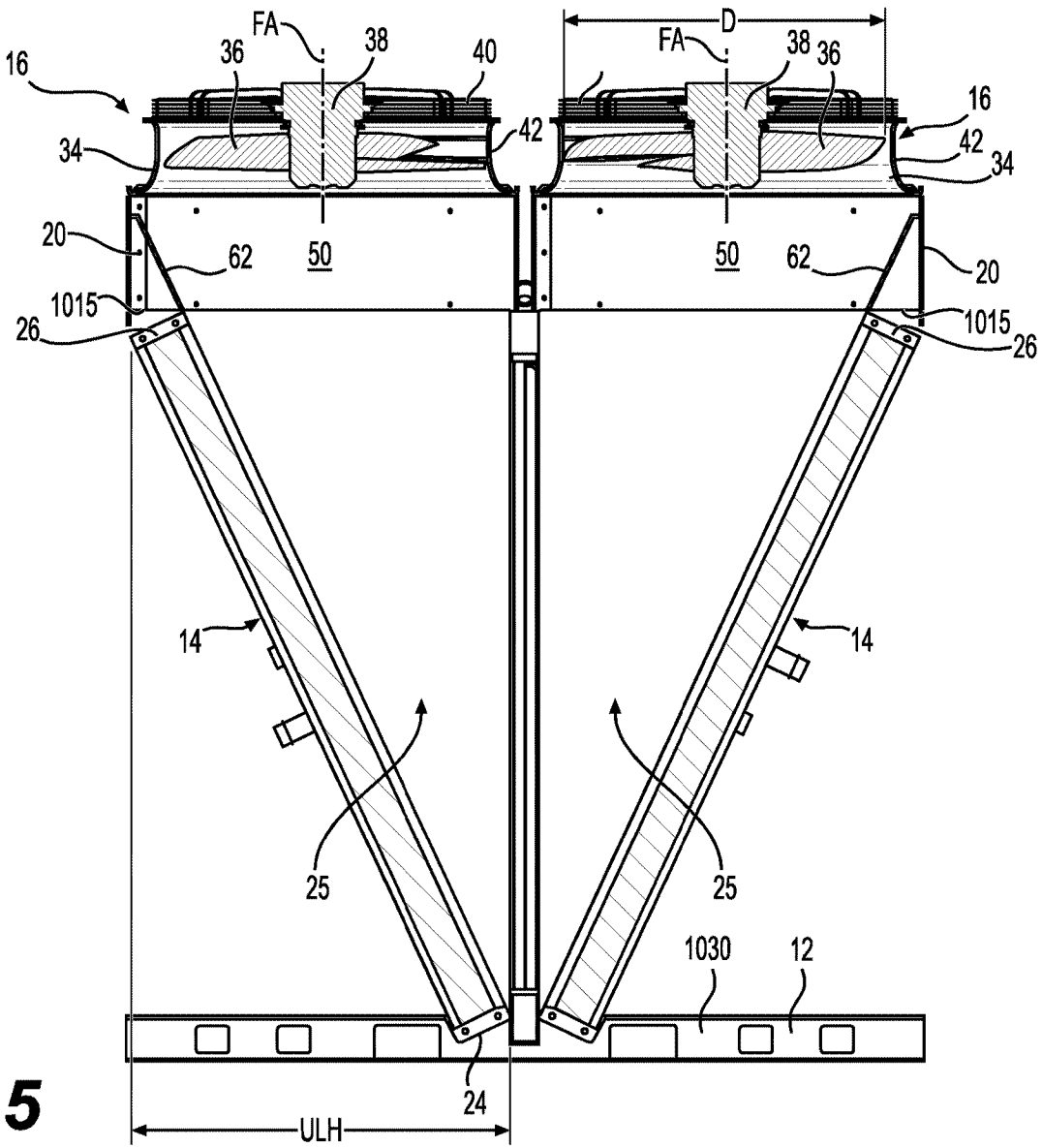
FIG. 15 is a cross-sectional view of the heat exchanger assembly of FIG. 1 taken along line 15-15 in FIG. 3.
Figure 16:
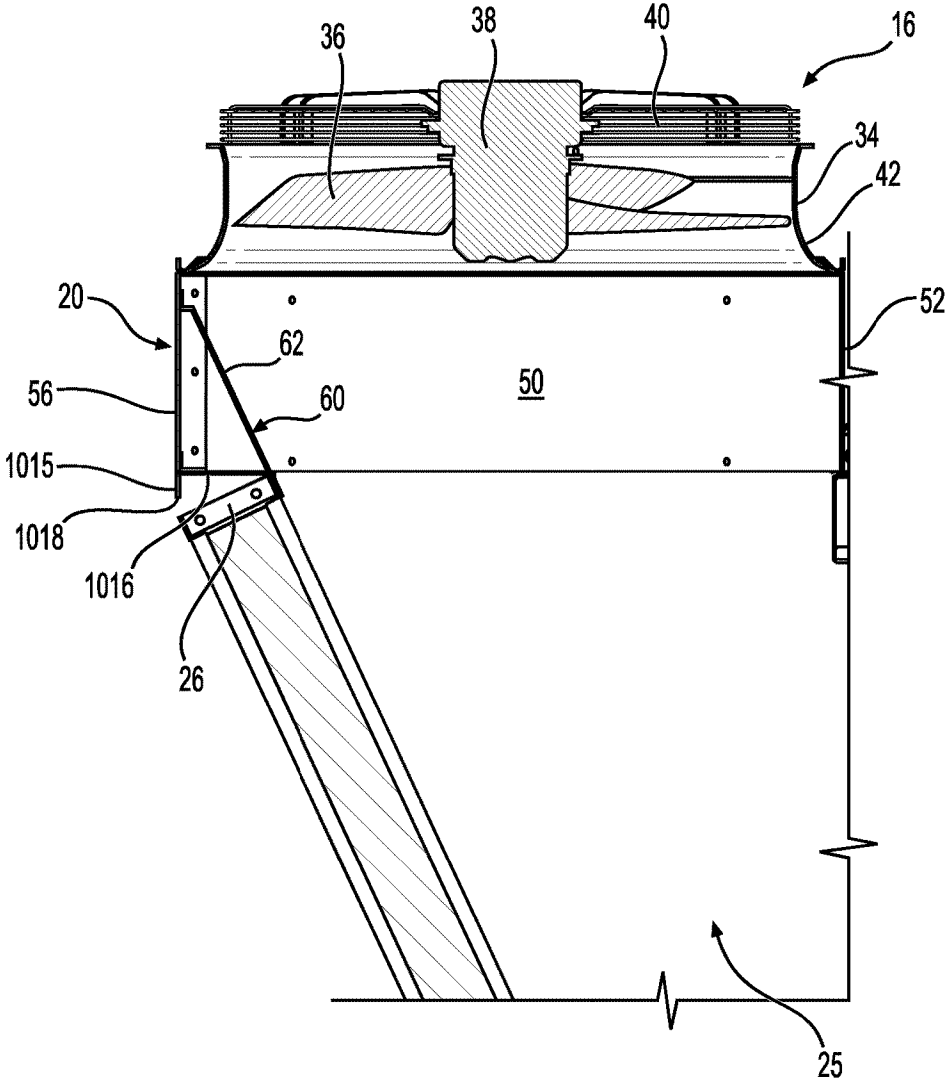
FIG. 16 is a part of the cross-sectional view of FIG. 11 shown in greater detail.

The fan assembly 16 comprises a fan mount 34 and a fan impeller 36 connected thereto (shown in FIGS. 15, 16). The fan mount 34 has an outer flange portion 44 and an annular portion 42 extending upwardly from the outer flange portion 44. The outer flange portion 44 of the fan mount 34 is connected to an upper end 47 of the corresponding casing 20, while the fan impeller 36 connects to the fan mount 34 via a motor 38 (FIG. 12) that is supported by the annular portion 42 of the fan mount 34. More specifically, a grill 40 covers and is affixed to the upper end of the annular portion 42 of the fan mount 34 and supports the motor 38 centrally thereof. The fan impeller 36 is rotatable by the motor 38 about a fan rotation axis FA extending generally vertically (i.e., parallel to the upstanding members 1036 of the frame 12).

The fan impeller 36 is of a significant size to provide the dry cooler 10 with efficient performance. For instance, in this embodiment, the fan impeller 36 has a diameter D of 950 mm. Given its significant size, the fan impeller 36 is sized and positioned such that part of the fan impeller 36 rotates vertically above the upper end 26 of a corresponding one of the heat exchanger panels 14. The fan impeller 36 is surrounded by the annular portion 42 of the fan mount 34. The fan impeller 36 may have an even greater diameter in other embodiments. For instance, in some embodiments, rather than having the middle enclosing panels 19, a larger fan impeller may be provided generally centered between the two heat exchanger panels disposed in the V-configuration.

The fan assemblies 16 are thus arranged to evacuate heated air upwardly from the interior space 25 of the dry cooler 10. Notably, in use, rotation of the fan impeller 36 of each fan assembly 16 causes ambient air to be pulled into dry cooler 10 through the corresponding heat exchanger panel 14. As air is pulled in, heat is transferred from fluid circulating in the tubing arrangement 28 of the heat exchanger panel 14 to the air, such that the air becomes heated. The heated air is then rejected upwardly from the interior space 25 of the dry cooler 10 through the fan assembly 16.

It is contemplated that, in other embodiments, rather than having two, or four fan assemblies 16 (i.e., a plurality of fan assemblies on each side of a vertical plane extending through the upstanding members 1036 of the frame 12), the dry cooler 10 may have a plurality of fan assemblies arranged laterally-adjacent to one another to form a single row of laterally-adjacent fan assemblies.

Figure 14:
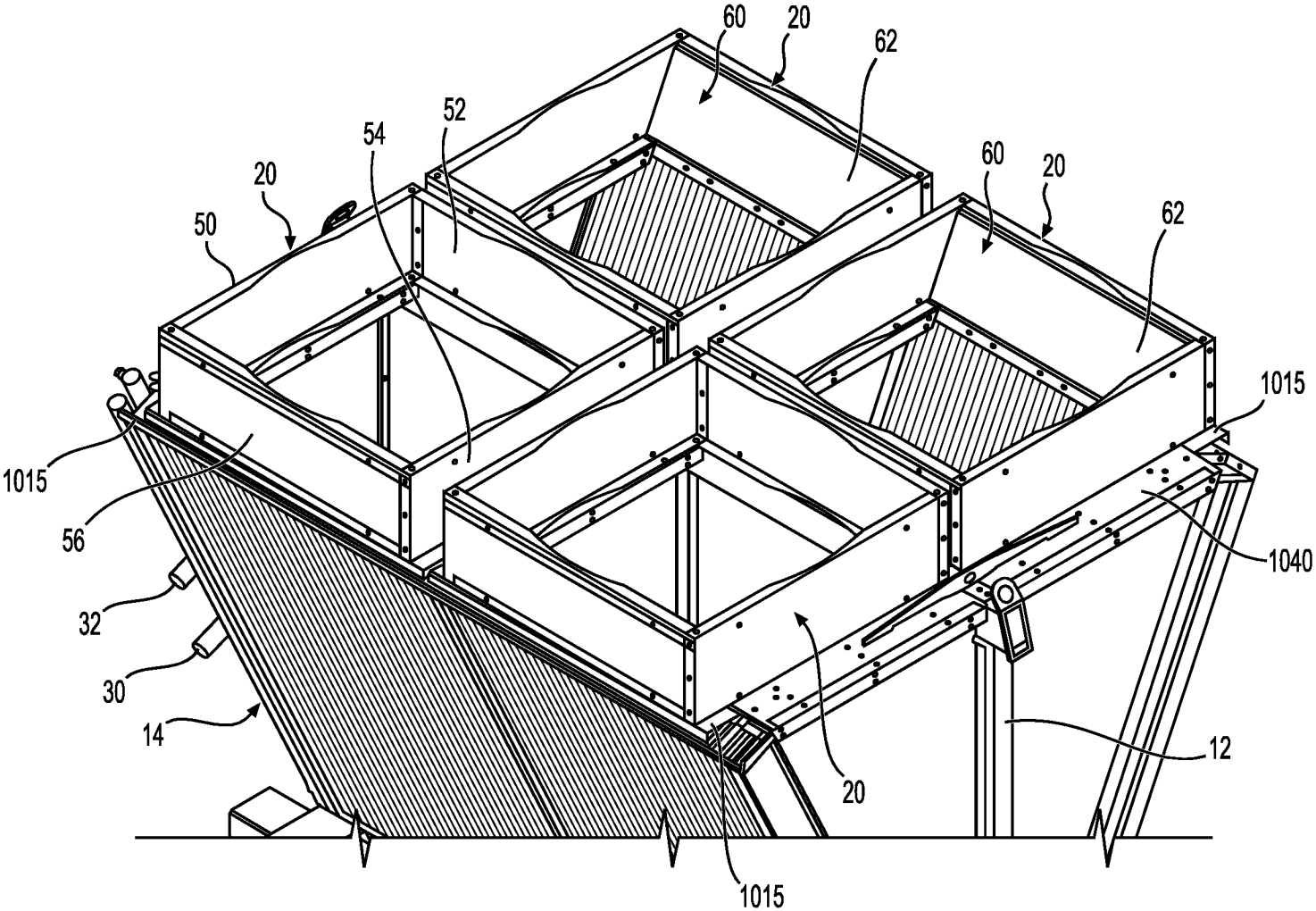
FIG. 14 is a perspective view of the heat exchanger assembly of FIG. 1 with fan assemblies thereof removed.

With reference to FIG. 14, the casings 20 are mounted to the upper frame assembly 1045. Specifically, each casing 20 is disposed between the upper frame assembly 1045 and a corresponding one of the fan assemblies 16. As such, each casing 20 is positioned between the corresponding fan assembly 16 and the upper end 26 of the corresponding heat exchanger panel 14, thus distancing the fan impeller from the outer fan supporting member 1015 disposed above the upper end 26 of the heat exchanger panel 14. This increased spacing between the fan impeller 36 and the outer fan supporting members 1015 results in a reduction in the turbulence and velocity of air at the area between the fan impeller and the outer fan supporting member 1015 compared to the conventional dry cooler 2010 of FIGS. 17 and 18, which in turn significantly reduces the blade-passing effect and the sound generated thereby. Furthermore, the distance created between the fan assembly 16 and the upper end 26 of the heat exchanger panel 14 allows for the installation of further means of noise reduction below the fan assembly 16 such as grids and the like, which can further reduce the blade-passing effect and sound generated by the dry cooler 10.

In this embodiment, each casing 20 is configured identically and therefore only one of the casings 20 will be described in detail herein. It is understood that the same description applies to the other casings 20.

With reference to FIGS. 8 to 13, the casing 20 includes four upright wall members 50, 52, 54, 56 which define the outer walls and thus the outer shape of the casing 20. In particular, in this embodiment, the upright wall members 50, 52, 54, 56 are affixed (e.g., welded) to one another to form the generally box-like shape of the casing 20. In particular, the two upright wall members 50, 54 extend generally parallel to one another while the two upright wall members 54, 56 extend generally parallel to one another (and perpendicularly to the upright wall members 50, 54). Each of the upright wall members 50, 52, 54, 56 has an upper lip portion 66 and a lower lip portion 68, and a central portion extending therebetween. The upper and lower lip portions 66, 68 of each of the upright wall member members 50, 52, 54, 56 extend perpendicularly to the central portion. The upper lip portions 66 of the upright wall members 50, 52, 54, 56 define an upper end 47 of the casing 20. Similarly, the lower lip portions 68 of the upright wall members 50, 52, 54, 56 define a lower end 49 of the casing 20. The upper end 47 thus accommodates the fan mount 34 of the fan assembly 16 so as to secure the fan mount 34 (e.g., via fasteners) to the upper end 47, while the lower end 49 is disposed atop the upper frame assembly 1045 (atop the corresponding outer fan supporting member 1015 and two of the upper retaining members 1040) and secured thereto.

Figure 11:
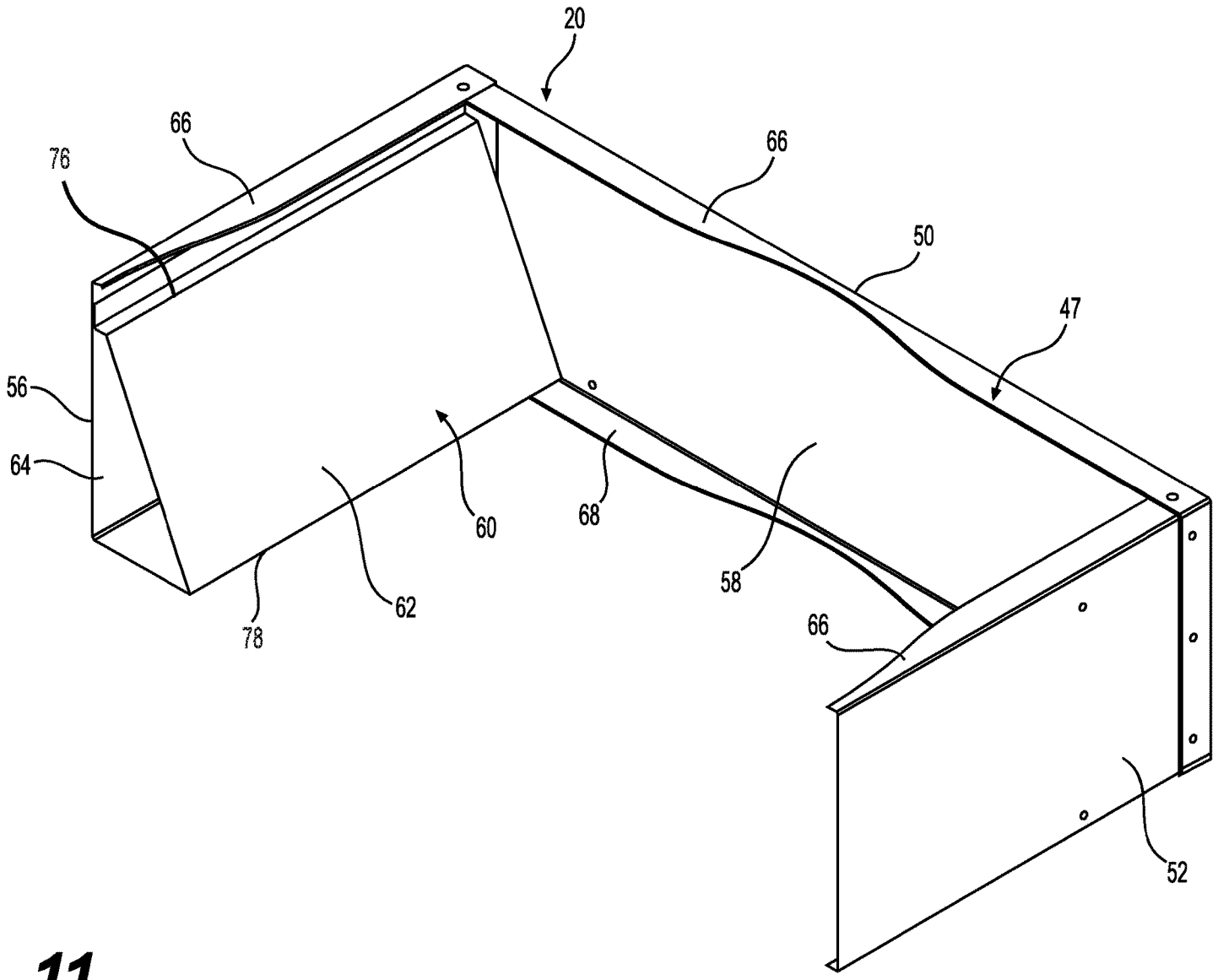
FIG. 11 is a perspective view of a cross-section of the casing of FIG. 8 taken along line 11-11 in FIG. 8.

As will be understood, the casing 20 is open from its upper end 47 and its lower end 49 so as to allow air to flow from the corresponding heat exchanger panel 14 towards the corresponding fan assembly 16. Notably, the casing 20 has a plurality of inner walls for guiding air from the heat exchanger panel 14 toward the fan assembly 16. In particular, the inner walls of the casing 20 include upright inner walls 58, 59, 61 defined by the upright wall components 50, 52, 54 respectively. The upright inner walls 58, 61 are parallel to one another while the upright inner wall 59 extends transversally to the upright inner walls 58, 61. Another inner wall 62 of the casing 20 is defined by a spoiler 60 of the casing 20 which is affixed (e.g., welded) to the upright wall member 56 and thus substantially covers an inner wall 64 of the upright wall member 56 (FIG. 11). The upright inner wall 59 faces the inner wall 62. Thus, as will be understood, the inner walls 58, 59, 61 and the spoiler 60 of the casing 20 are arranged so as to define in part the interior space 25 of the dry cooler 10.

The spoiler 60 is provided to modify the dynamics of air flow between the heat exchanger panel 14 and the fan assembly 16. As shown in FIG. 11, the spoiler 60 has a lower portion 70 and a sloped portion 72 extending at angle to the lower portion 70. Notably, the lower portion 70 extends generally horizontally while the sloped portion 72 extends at an acute angle relative to the lower portion 70. The sloped portion 72 defines the inner wall 62 of the casing 20 and therefore the inner wall 62 may be referred to as a sloped wall 62. The sloped wall 62 is oriented to extend outwardly away from the fan rotation axis FA of the corresponding fan assembly 16. As such, in a given vertical plane containing the fan rotation axis and extending through the sloped wall 62, a distance between an upper end 76 of the sloped wall 62 and the fan rotation axis FA of the corresponding fan assembly 16 is greater than a distance between a lower end 78 of the sloped wall 62 and the fan rotation axis FA. As shown in FIG. 16, the sloped wall 62 is disposed adjacent to the upper end 26 of the corresponding heat exchanger panel 14 and extends generally parallel to the inclined orientation of the heat exchanger panel 14 such that part of the fan impeller 36 rotates vertically above the sloped wall 62. As such, an angle θ is formed between the sloped wall 62 of the casing 20 and a vertical plane VP extending laterally (parallel to the inner walls 59, 64). In this embodiment, as shown in FIG. 11, the angle θ between the sloped wall 62 of the casing 20 and the vertical plane VP is about 25°. The angle θ can be smaller or greater than 25° in other embodiments. For instance, in some embodiments, the angle θ may be between about 20° and about 40° inclusively, between about 20° and about 35° inclusively, or between about 20° and about 30° inclusively.

The angular orientation of the sloped wall 62 of the casing 20 has been found to further decrease the turbulent flow of air generated by the blade-passing effect. Therefore, the angular orientation of the sloped wall 62 results in an even greater reduction in sound emission by the dry cooler 10 than if the fan impeller 36 were only distanced further from the outer fan supporting member 1015. Furthermore, this decrease in turbulent flow further optimizes air flow at the entrance of the fan assembly 16 (as air enters the fan assembly 16 from the heat exchanger panel 14) and increases the overall performance of the dry cooler 10. By the same token, the life span of the fan impeller 36 is extended due to the reduced turbulent air flow compared to conventional dry coolers such as the conventional dry cooler 2010 of FIGS. 17 and 18, notably due to an accompanying reduction in vibrations.

While the casing 20 reduces turbulent air flow within the interior space 25, it also increases a height of the dry cooler 10. To that end, the casing 20 is configured to elevate the corresponding fan assembly 16 sufficiently to distance the fan impeller 36 from the upper end 26 of the corresponding heat exchanger panel 14 while simultaneously avoiding having an excessively tall dry cooler 10 which would be more difficult to accommodate during transportation thereof. As such, a height HC (FIG. 10) of the casing 20, measured from the upper end 47 to the lower end 49, is significant enough for the sloped wall 62 to extend over a sufficiently long distance and thus positively affecting air flow, but not so significant as to render difficult the transport and/or the storage of the dry cooler 10. For instance, in this embodiment, a ratio of the height HC of the casing 20 over a diameter D of the fan impeller 36 (FIG. 15) is between 0.20 and 0.40. In particular, in this embodiment, the ratio of the height HC of the casing 20 over a diameter D of the fan impeller 36 is approximately 0.30 Furthermore, in this embodiment, a ratio of the height HC of the casing 20 over a vertical distance ULV (FIG. 4) between the upper and lower ends 24, 26 of the heat exchanger panel 14 is between 0.10 and 0.20. In particular, in this embodiment, the ratio of the height HC of the casing 20 over the vertical distance ULV is approximately 0.15.

For instance, in this embodiment, the height H of the casing is about 320 mm. However, it is contemplated that the height H of the casing may be between about 200 mm and 400 mm inclusively or between about 200 mm and 350 mm inclusively.

As will be understood, the provision of the casing 20 allows the installation of a bigger fan impeller 36 on the dry cooler 10 which would otherwise cause excessive turbulent air flow within the dry cooler 10 if it were not for the presence of the casing 20. As mentioned above, a bigger fan impeller 36 (i.e., having a greater diameter) improves the efficiency of the dry cooler 10 and therefore is a desirable improvement. However, the desirability of having a bigger fan impeller 36 also runs contrary to the desire of limiting the width of a dry cooler 10 to facilitate its transport (e.g., to more easily fit in a shipping container). For instance, the dry cooler 10 has a maximal width of about 2200 mm to fit in a shipping container. The casing 20 thus provides the dry cooler 10 with the possibility of having the fan impeller 36 of a significant size while also having the width of the dry cooler 10 be relative small. For instance, in this embodiment, a ratio of the diameter D of the fan impeller 36 over a horizontal distance ULH (FIG. 15) between the upper and lower ends 24, 26 of the corresponding heat exchanger panel 14 is between 0.80 and 1.20. In particular, in this embodiment, the ratio of the diameter D of the fan impeller 36 over the horizontal distance ULH is approximately 0.90.

In this embodiment, the casing 20 is made of sheet metal. In some embodiments, the sheet metal may be made of any other suitable, including for example one or more of steel, stainless steel, galvanized steel, aluminum, brass, zinc and the like.

Modifications and improvements to the above-described implementations of the present technology may become apparent to those skilled in the art. The foregoing description is intended to be exemplary rather than limiting. The scope of the present technology is therefore intended to be limited solely by the scope of the appended claims.

What is claimed is:

1. A heat exchanger assembly, comprising:

a frame;

a heat exchanger panel mounted to the frame and configured to exchange heat with air flowing therethrough, the heat exchanger panel having a lower end and an upper end, the heat exchanger panel being disposed at an inclined orientation such that the upper and lower ends thereof are offset from one another, the heat exchanger panel comprising:

a tubing arrangement for circulating fluid therein; and a plurality of fins in thermal contact with the tubing arrangement, the fins being spaced apart from one another for air to flow therebetween and into an interior space of the heat exchanger assembly;

a plurality of enclosing panels connected to the frame and defining in part the interior space of the heat exchanger assembly;

a fan assembly disposed vertically above the heat exchanger panel, the fan assembly comprising:

a fan mount; and a fan impeller connected to the fan mount, the fan impeller being rotatable about a fan rotation axis to pull air into the interior space of the heat exchanger assembly through the heat exchanger panel and evacuate heated air upwardly from the interior space of the heat exchanger assembly through the fan assembly, the fan impeller being sized and positioned such that part of the fan impeller rotates vertically above the upper end of the heat exchanger panel;

a casing mounted to the frame between the fan assembly and the upper end of the heat exchanger panel, the casing comprising a plurality of inner walls for guiding air from the heat exchanger panel toward the fan assembly such that the inner walls of the casing define in part the interior space of the heat exchanger assembly, the plurality of inner walls of the casing including a sloped wall extending from a lower end to an upper end, a distance between the upper end of the sloped wall and the fan rotation axis being greater than a distance between the lower end of the sloped wall and the fan rotation axis, the sloped wall being adjacent to the upper end of the heat exchanger panel such that the part of the fan impeller rotates vertically above the sloped wall.

2. The heat exchanger assembly of claim 1, wherein the sloped wall extends generally parallel to the inclined orientation of the heat exchanger panel.

3. The heat exchanger assembly of claim 1, wherein an angle between the sloped wall of the casing and a vertical plane is between 20° and 40° inclusively.

4. The heat exchanger assembly of claim 1, wherein the fan rotation axis extends generally vertically.

5. The heat exchanger assembly of claim 1, wherein a ratio of a height of the casing over a diameter of the fan impeller is between 0.20 and 0.40.

6. The heat exchanger assembly of claim 1, wherein a ratio of a height of the casing over a vertical distance between the upper and lower ends of the heat exchanger panel is between 0.10 and 0.20.

7. The heat exchanger assembly of claim 1, wherein a ratio of a diameter of the fan impeller over a horizontal distance between the upper and lower ends of the heat exchanger panel is between 0.80 and 1.20.

8. The heat exchanger assembly of claim 1, wherein a height of the casing is between 200 and 400 mm inclusively.

9. The heat exchanger assembly of claim 8, wherein the height of the casing is between 250 and 350 mm inclusively.

10. The heat exchanger assembly of claim 9, wherein the height of the casing is approximately 320 mm.

11. The heat exchanger assembly of claim 1, wherein the plurality of inner walls of the casing also includes:

two parallel walls; and a transversal wall extending between the two parallel walls and facing the sloped wall.

12. The heat exchanger assembly of claim 1, wherein the casing is made of sheet metal.

13. The heat exchanger assembly of claim 1, wherein:

the heat exchanger panel is a first heat exchanger panel;

the fan assembly is a first fan assembly, and the fan rotation axis is a first fan rotation axis;

the casing is a first casing; and the heat exchanger assembly further comprises:

a second heat exchanger panel mounted to the frame and configured to exchange heat with air flowing therethrough, the second heat exchanger panel having a lower end and an upper end, the second heat exchanger panel being disposed at an inclined orientation such that the upper and lower ends thereof are offset from one another, the first and second heat exchanger panels being disposed in a V-configuration such that a distance between the upper ends of the first and second heat exchanger panels is greater than a distance between the lower ends of the first and second heat exchanger panels, the second heat exchanger panel comprising:

a tubing arrangement for circulating fluid therein; and a plurality of fins in thermal contact with the tubing arrangement of the second heat exchanger panel, the fins of the second heat exchanger panel being spaced apart from one another for air to flow therebetween and into the interior space of the heat exchanger assembly;

a second fan assembly disposed vertically above the second heat exchanger panel, the second fan assembly comprising:

a fan mount; and a fan impeller connected to the fan mount of the second fan assembly, the fan impeller of the second fan assembly being rotatable about a second fan rotation axis to pull air into the interior space of the heat exchanger assembly through the second heat exchanger panel and evacuate heated air upwardly from the interior space of the heat exchanger assembly through the second fan assembly, the fan impeller of the second fan assembly being sized and positioned such that part thereof rotates vertically above the upper end of the second heat exchanger panel;

a second casing mounted to the frame between the second fan assembly and the upper end of the second heat exchanger panel, the second casing comprising a plurality of inner walls for guiding air from the second heat exchanger panel toward the second fan assembly such that the inner walls of the second casing define in part the interior space of the heat exchanger assembly, the plurality of inner walls of the second casing including a sloped wall extending from a lower end to an upper end, a distance between the upper end of the sloped wall of the second casing and the second fan rotation axis being greater than a distance between the lower end of the sloped wall of the second casing and the second fan rotation axis, the sloped wall of the second casing being adjacent to the upper end of the second heat exchanger panel such that the part of the fan impeller of the second fan assembly rotates vertically above the sloped wall of the second casing.

14. The heat exchanger assembly of claim 13, wherein the sloped wall of the second casing extends generally parallel to the inclined orientation of the second heat exchanger panel.

15. The heat exchanger assembly of claim 14, wherein the frame comprises:

a first leg and a second leg laterally spaced apart from the first leg;

at least one lower transversal member extending laterally and interconnecting the first and second legs;

a first upstanding member and a second upstanding member laterally spaced apart from the first upstanding member, the first and second upstanding members extending upwardly from the first and second legs;

an upper transversal member extending laterally and connected to upper ends of the first and second upstanding members; and an upper frame assembly affixed to the upper transversal member and supporting the first and second casings, wherein:

the first and second heat exchanger panels are disposed on opposite sides of a vertical plane extending through the first and second upstanding members; and the first fan rotation axis and the second fan rotation axis are disposed on opposite sides of the vertical plane extending through first and second upstanding members.

* * * * *